US011854478B2

(12) United States Patent
Moriya et al.

(10) Patent No.: US 11,854,478 B2
(45) Date of Patent: Dec. 26, 2023

(54) DISPLAY DEVICE AND DRIVE METHOD FOR SAME

(71) Applicant: SHARP KABUSHIKI KAISHA, Sakai (JP)

(72) Inventors: Masaaki Moriya, Sakai (JP); Masafumi Ueno, Sakai (JP); Naoki Shiobara, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 109 days.

(21) Appl. No.: 17/609,290

(22) PCT Filed: May 31, 2019

(86) PCT No.: PCT/JP2019/021699
§ 371 (c)(1),
(2) Date: Nov. 5, 2021

(87) PCT Pub. No.: WO2020/240815
PCT Pub. Date: Dec. 3, 2020

(65) Prior Publication Data

US 2022/0215802 A1 Jul. 7, 2022

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01); *G09G 2320/041* (2013.01)

(58) Field of Classification Search
CPC .. G09G 3/3233; G09G 3/3266; G09G 3/3291; G09G 2320/041
See application file for complete search history.

(56) References Cited

U.S. PATENT DOCUMENTS

2005/0122305 A1* 6/2005 Murao ..... G09G 3/3648 345/101
2006/0197740 A1* 9/2006 Xu ..... G06F 1/206 345/156

(Continued)

FOREIGN PATENT DOCUMENTS

JP 2010-224262 A 10/2010
JP 2012-078798 A 4/2012
WO 2014/021201 A1 2/2014

*Primary Examiner* — Kenneth B Lee, Jr.
(74) *Attorney, Agent, or Firm* — ScienBiziP, P.C.

(57) ABSTRACT

The present application discloses a current-driven display device that can perform accurate external compensation in consideration of a temperature distribution in a display panel while preventing the configuration from being complicated. A display portion of an organic EL display device is provided with a plurality of temperature detection circuits in addition to pixel circuits arranged in a matrix. A data-side drive circuit measures a current flowing through a transistor in each temperature detection circuit. A display control circuit obtains a temperature from the measured value based on a temperature characteristic of the transistor, estimates a temperature of each pixel circuit from the temperature, corrects a current value measured at the time of characteristic detection for a drive transistor of each pixel circuit considering the estimated temperature, and updates correction data for compensating for variations in the threshold voltage and gain of the drive transistor based on the corrected current value.

17 Claims, 23 Drawing Sheets

(56) References Cited

U.S. PATENT DOCUMENTS

| | | | | |
|---|---|---|---|---|
| 2007/0222718 | A1* | 9/2007 | Takahara | G09G 3/2011 345/76 |
| 2010/0045709 | A1* | 2/2010 | Nakamura | G09G 3/3233 345/690 |
| 2012/0056537 | A1 | 3/2012 | Koyama | |
| 2015/0213757 | A1 | 7/2015 | Takahama et al. | |
| 2018/0293945 | A1* | 10/2018 | Wang | G09G 3/3291 |
| 2020/0060004 | A1* | 2/2020 | Baumheinrich | H05B 45/44 |
| 2021/0048860 | A1* | 2/2021 | Jinta | G09G 3/3648 |

* cited by examiner

DISPLAY DEVICE AND DRIVE METHOD FOR SAME

TECHNICAL FIELD

The disclosure relates to a display device and more particularly relates to a current-driven display device including a display element that is driven by a current, such as an organic electro luminescence (EL) display device, and to a drive method for the display device.

BACKGROUND ART

An organic EL display device is known as a thin, high-quality, and low-power display device. An active matrix-type organic EL display device is provided with a plurality of pixel circuits arranged two-dimensionally, and each pixel circuit includes an organic EL element, a drive transistor, and a holding capacitor. The organic EL element is a self-luminous display element with its luminance changing in accordance with a drive current. The drive transistor controls a drive current flowing through the organic EL element in accordance with a data voltage written to the holding capacitor.

Generally, a thin-film transistor (hereinafter abbreviated as "TFT") is used as a drive transistor in a pixel circuit. Specifically, an amorphous silicon TFT, a low-temperature polysilicon TFT, an oxide TFT (also referred to as "oxide semiconductor TFT"), or the like is used for the drive transistor. The oxide TFT is a TFT in which a semiconductor layer is formed of an oxide semiconductor. For example, indium gallium zinc oxide (In—Ga—Zn—O) is used for the oxide TFT.

The gain of a metal-oxide-semiconductor (MOS) transistor such as a TFT is determined by mobility, a channel width, a channel length, a gate insulating film capacitance, and the like, and the amount of current flowing through the MOS transistor changes in accordance with a gate-source voltage, gain, threshold voltage, and the like. When the TFT is used for the drive transistor, variations occur in the threshold voltage, mobility, and the like, thereby causing variations in the amount of the drive current flowing through the organic EL element. As a result, luminance unevenness occurs in the display image, and display quality deteriorates In contrast, in order to reduce luminance unevenness of a display image due to variations in the characteristics of the drive transistor, there is a configuration in which a drive current to be supplied from the drive transistor to the organic EL element is taken to the outside of a pixel circuit and measured, and on the basis of the measurement result, a data voltage to be written to each pixel circuit is corrected so as to compensate for the variations in the characteristics. Hereinafter, a method for compensating for the variations in the characteristics of the drive transistor with such a configuration is referred to as an "external compensation method".

Patent Document 1 (WO 2014/021201) discloses an organic EL display device employing such an external compensation method. In the organic EL display device, a data driver transmits first and second measurement data corresponding to first and second measurement data voltages to a controller 10, and the controller updates threshold voltage correction data and gain correction data on the basis of the first and second measurement data and corrects video data on the basis of the threshold voltage correction data and the gain correction data. As a result, both threshold voltage compensation and the gain compensation of the drive transistor are performed for each pixel circuit while the display is performed.

CITATION LIST

Patent Documents

[Patent Document 1] WO 2014/021201 [Patent Document 2] Japanese Laid-Open Patent Publication No. 2010-224262 [Patent Document 3] Japanese Laid-Open Patent Publication No. 2012-78798

SUMMARY

Problems to be Solved

In the organic EL display device adopting the external compensation method, a current flowing through the drive transistor in each pixel circuit is measured, and data voltage to be written to the pixel circuit is corrected on the basis of the measurement result (hereinafter referred to as "current monitoring result"), whereby variations in the characteristics of the drive transistor are compensated. However, the current monitoring result increases or decreases depending on the temperature. Thus, for accurately performing such external compensation, it is necessary to correct the current monitoring result in accordance with a temperature distribution of a display panel in which the plurality of pixel circuits are arranged two-dimensionally.

In contrast, Patent Document 2 and Patent Document 3 each disclose a display device including a circuit for detecting a temperature for each pixel circuit. However, when a circuit for temperature detection is provided for each pixel circuit as described above, the configuration of the display device becomes complicated, which is disadvantageous for high definition of the display image.

Therefore, it is desirable to provide a current-driven display device that can perform accurate external compensation in consideration of a temperature distribution in a display panel while preventing the configuration from being complicated.

Solution to Problem

Several embodiments of the disclosure provide a display device including:

- a display portion including a plurality of data signal lines, a plurality of scanning signal lines intersecting the plurality of data signal lines, and a plurality of pixel circuits arranged along the plurality of data signal lines and the plurality of scanning signal lines;
- a data signal line drive circuit configured to drive the plurality of data signal lines;
- a scanning signal line drive circuit configured to selectively drive the plurality of scanning signal lines;
- an external compensation circuit configured to measure a current flowing through each of the pixel circuits and compensate for a variation in a characteristic of each of the pixel circuits;
- two or more temperature detection circuits arranged to respectively correspond to two or more intersections among intersections of the plurality of data signal lines and the plurality of scanning signal lines; and
- a temperature measurement circuit configured to measure the temperature of each of the temperature detection circuits, wherein each of the pixel circuits includes a display element driven by a current, a holding capacitor, and a drive transistor that controls a drive current of the display element in accordance with a voltage held in the holding capacitor, and is configured such that a voltage of a corresponding data signal line is written to the holding capacitor when a corresponding scanning signal line is selected, each of the temperature detection circuits includes a temperature detecting transistor, the temperature measurement circuit measures a current flowing through the temperature detecting transistor in each of the temperature detection circuits to obtain a temperature of the temperature detection circuit, and the external compensation circuit estimates a temperature distribution in the display portion on a basis of the temperature of each of the temperature detection circuits obtained by the temperature measurement circuit, corrects a measurement result of a current in each of the pixel circuits on a basis of the estimated temperature distribution, and compensates for a variation in a characteristic of each of the pixel circuits on a basis of the corrected measurement result.

Several other embodiments of the disclosure provide a drive method for a display device provided with a display portion including a plurality of data signal lines, a plurality of scanning signal lines intersecting the plurality of data signal lines, and a plurality of pixel circuits arranged along the plurality of data signal lines and the plurality of scanning signal lines, wherein the display portion includes two or more temperature detection circuits arranged to respectively correspond to two or more intersections among intersections of the plurality of data signal lines and the plurality of scanning signal lines, each of the pixel circuits includes a display element driven by a current, a holding capacitor, and a drive transistor that controls a drive current of the display element in accordance with a voltage held in the holding capacitor, and is configured such that a voltage of a corresponding data signal line is written to the holding capacitor when a corresponding scanning signal line is selected, each of the temperature detection circuits includes a temperature detecting transistor, the drive method includes:

a data signal line driving step of driving the plurality of data signal lines;

a scanning signal line driving step of selectively driving the plurality of scanning signal lines;

an external compensation step of measuring a current that flows through each of the pixel circuits and compensating for a variation in a characteristic of each of the pixel circuits; and a temperature measurement step of measuring a current flowing through the temperature detecting transistor in each of the temperature detection circuits to obtain a temperature of the temperature detection circuit, and in the external compensation step, a temperature distribution in the display portion is estimated on a basis of the temperature of each of the temperature detection circuits obtained by the temperature measurement step, a measurement result of a current in each of the pixel circuits is corrected on a basis of the estimated temperature distribution, and a variation in a characteristic of each of the pixel circuits is compensated for on a basis of the corrected measurement result.

Effects of the Disclosure

In the above several embodiments of the disclosure, two or more temperature detection circuits are arranged in the display portion so as to correspond to two or more intersections among intersections of the plurality of data signal lines and the plurality of scanning signal lines, and the temperature of the temperature detection circuit is obtained by measuring the current flowing through the temperature detecting transistor in each temperature detection circuit. The temperature distribution in the display portion is estimated on the basis of the temperature of each temperature detection circuit obtained in this manner, and the current value (current monitoring result) of the pixel circuit measured for compensating for the variation in the characteristic of each pixel circuit is corrected on the basis of the temperature distribution. The variation in the characteristic of each pixel circuit is compensated on the basis of the current value corrected in this manner, that is, the current monitoring result after the temperature compensation. Therefore, according to the above several embodiments of the disclosure, even when the temperature of each pixel circuit changes in accordance with a display content in a normal display mode, it is possible to accurately compensate for the variation in the characteristic in each pixel circuit on the basis of the current value of each pixel circuit measured immediately after the display. Further, according to the above several embodiments of the disclosure, a circuit for detecting a temperature for each pixel circuit is not provided, but a smaller number of temperature detection circuits than before are used to consider the temperature distribution in the display portion, so that it is possible to compensate for the characteristic of the pixel circuit (specifically, the characteristic of the drive transistor). In this way, it is possible to perform accurate external compensation in consideration of the temperature distribution in the display portion while preventing the configuration from being complicated.

DESCRIPTION OF EMBODIMENTS

Each embodiment will be described below with reference to the accompanying drawings. In each transistor described below, a gate terminal corresponds to a control terminal, one of a drain terminal and a source terminal corresponds to a first conductive terminal, and the other corresponds to a second conductive terminal. All the transistors in each embodiment are of N-channel type, but the disclosure is not limited thereto. The transistor in each embodiment is, for example, a thin-film transistor, but the disclosure is not limited thereto. Further, "connection" in the present specification means "electrical connection" unless otherwise specified and includes not only the case of meaning direct connection but also the case of meaning indirect connection via another element in the scope not deviating from the gist of the disclosure.

1. First Embodiment

1.1 Overall Configuration and Operation Overview

Figure 1:
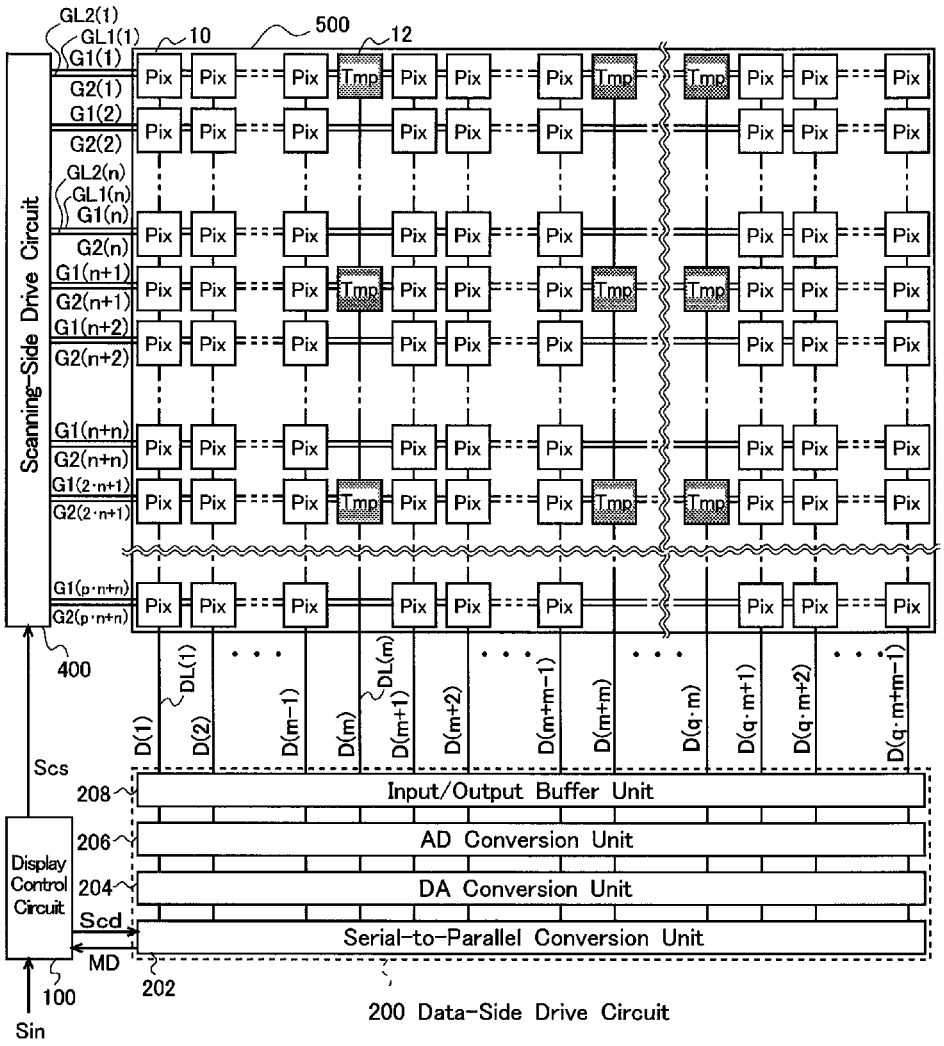
FIG. 1 is a block diagram illustrating an overall configuration of an organic EL display device according to a first embodiment.

FIG. 1 is a block diagram illustrating an overall configuration of an active matrix-type organic EL display device according to a first embodiment. The organic EL display device includes a display control circuit 100, a data-side drive circuit 200, a scanning-side drive circuit 400, and a display panel 500 as a display portion (hereinafter referred to as "display portion 500"). The data-side drive circuit 200 includes a serial-to-parallel conversion unit 202, a digital-to-analog (DA) conversion unit 204, an analog-to-digital (AD) conversion unit 206, and an input/output buffer unit 208. One or both of the scanning-side drive circuit 400 and the data-side drive circuit 200 may be integrally formed with the display portion 500. The organic EL display device includes a power supply circuit (not illustrated) that generates a high-level power supply voltage ELVDD and a low-level power supply voltage ELVSS, described later, to be supplied to the display portion 500, and a power supply voltage (not illustrated) to be supplied to the display control circuit 100, the data-side drive circuit 200, and the scanning-side drive circuit 400.

The organic EL display device according to the present embodiment has a function of compensating for variations and deterioration in characteristics of a drive transistor in a pixel circuit by an external compensation method (more generally, a function of compensating for a difference in characteristic between pixel circuits in the display portion 500 and a variation in the characteristic of each pixel circuit) and includes, as operation modes, a normal display mode in which an image is displayed on the display portion 500 on the basis of an input signal Sin from the outside and a characteristic detection mode in which a current flowing through the drive transistors in each pixel circuit is measured for external compensation (details will be described later). The switching of the operation mode between the normal display mode and the characteristic detection mode may be achieved by including a mode control signal Cm designating the operation mode in the input signal Sin or may be achieved by providing a switch for manually switching the operation mode in the organic EL display device and generating the mode control signal Cm in accordance with the operation of the switch.

As illustrated in FIG. 1, in the organic EL display device according to the present embodiment, in the display portion 500, M (M is an integer of 2 or more) data signal lines DL(1) to DL(M) are provided, and N (N is an integer of 2 or more) scanning signal lines GL1(1) to GL1(N) and N monitoring control lines GL2(1) to GL2(N) crossing the data signal lines DL(1) to DL(M) are provided. Further, in the display portion 500, a large number of pixel circuits 10 are arranged in a matrix along the M data signal lines DL(1) to DL(M) and the N scanning signal lines GL1(1) to GL1(N). Each pixel circuit 10 is connected to any one of the M data signal lines DL(1) to DL(M), is connected to any one of the N scanning signal lines GL1(1) to GL1(N), and is also connected to any one of the N monitoring control lines GL2(1) to GL2(N). However, the M data signal lines DL(1) to DL(M) include one data signal line to which none of the pixel circuits 10 is connected in a ratio of one to m data signal lines (q data signal lines in the entire display portion 500), and one temperature detection circuit 12 is connected to each of the q data signal lines DL(m), DL(2*m*), . . . , DL(q·m) for each n scanning signal lines (hereinafter, the data signal line to which the temperature detection circuit 12 is connected is referred to as a "temperature detecting data signal line"). Here, when N=p·n+n and M=q·m+m−1, each temperature detection circuit 12 is connected to any one of the q temperature detecting data signal lines DL(k·m) (k=1 to q), is connected to any one of the p+1 scanning signal lines GL1((*k*−1)n+1) (k=1 to p+1), and is also connected to any one of the p+1 monitoring control lines GL2((*k*−1)n+1) (k=1 to p+1). In the following description, it is assumed that symbol "Pix(i, j)" is used to distinguish the pixel circuit 10 connected to the ith scanning signal line GL1(*i*) and the jth data signal line DL(j) from other pixel circuits 10, and symbol "Tmp(i, j)" is used to distinguish the temperature detection circuit 12 connected to the ith scanning signal line GL1(*i*) and the jth data signal line DL(j) from other temperature detection circuits 12.

In the display portion 500, a power supply line (not illustrated) common to each pixel circuit 10 and each temperature detection circuit 12 is disposed. That is, there are provided a first power supply line configured to supply a high-level power supply voltage ELVDD for driving the organic EL element (also referred to as "OLED") to be described later (hereinafter, the line will be referred to as a "high-level power supply line" and denoted by the same symbol "ELVDD" as the high-level power supply voltage) and a second power supply line configured to supply a low-level power supply voltage ELVSS for driving the organic EL element (hereinafter, the line will be referred to as "low-level power supply line" and denoted by the same symbol "ELVSS" as the low-level power supply voltage).

The display control circuit 100 receives an input signal Sin including image data representing an image to be displayed and timing control information for image display from the outside of the display device, generates a data-side control signal Scd and a scanning-side control signal Scs on the basis of the input signal Sin, and outputs data-side control signal Scd and the scanning-side control signal Scs to the data-side drive circuit 200 and the scanning-side drive circuit 400, respectively. Further, the display control circuit 100 receives measurement data MD from the data-side drive circuit 200 in the characteristic detection mode (details will be described later).

Figure 2:
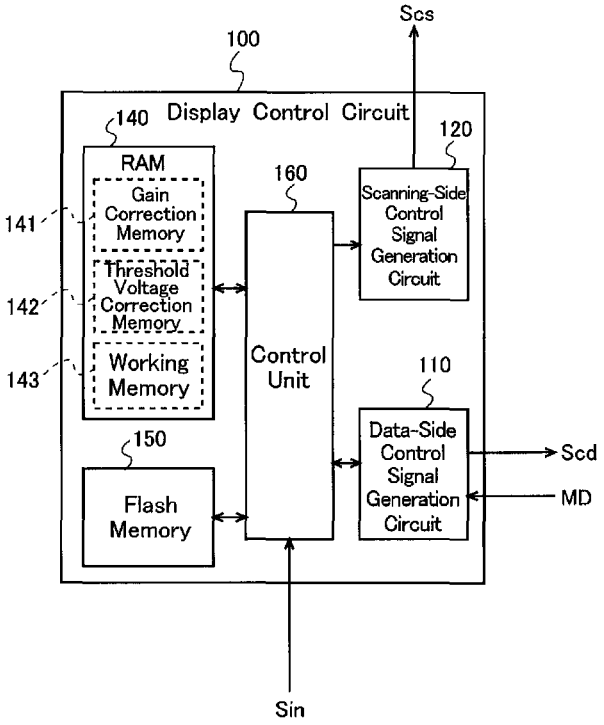
FIG. 2 is a block diagram illustrating a configuration of a display control circuit in the first embodiment.

FIG. 2 is a block diagram illustrating a configuration of the display control circuit 100. The display control circuit 100 includes a data-side signal generation circuit 110, a scanning-side signal generation circuit 120, a random access memory (RAM) 140, a flash memory 150 as a nonvolatile memory, and a control unit 160. The control unit 160 controls the data-side signal generation circuit 110, the scanning-side signal generation circuit 120, the RAM 140, and the flash memory 150 on the basis of the input signal Sin from the outside. The data-side signal generation circuit 110 generates the above-described data-side control signal Scd to be provided to the data-side drive circuit 200 under the control of the control unit 160, and the scanning-side signal generation circuit 120 generates the above-described scanning-side control signal Scs to be provided to the scanning-side drive circuit 400 under the control of the control unit 160. The RAM 140 includes a region as a gain correction memory 141, a region as a threshold voltage correction memory 142, and a region as a working memory 143. The control unit 160 performs writing and reading of data to be stored into the RAM 140 and writing and reading of data to be stored into the flash memory 150.

The data-side control signal Scd includes image data V1 representing an image to be displayed on the display portion 500, and the image data V1 is generated by performing correction processing on image data V0 included in the input signal Sin. The RAM 140 stores two types of correction data (gain correction data and threshold voltage correction data to be described later), which are used to correct the image data V0, for each pixel circuit 10. The display control circuit 100 corrects the image data V0 by using the correction data stored in the RAM 140 to generate the image data V1. Further, the display control circuit 100 updates the correction data stored in the RAM 140 on the basis of the measurement data MD received from the data-side drive circuit 200. When the power is turned off, the display control circuit 100 reads the correction data stored in the RAM 140 and writes the correction data to the flash memory 150. When the power is turned on, the display control circuit 100 reads the correction data stored in the flash memory 150 and writes the correction data to the RAM 140.

In the normal display mode, the data-side drive circuit 200 functions as the data signal line drive circuit and drives the data signal lines DL(1) to DL(M) (M=q·m+m−1) on the basis of the data-side control signal Scd from the display control circuit 100. That is, the data-side drive circuit 200 outputs M data signals D(1) to D(M) representing images to be displayed in parallel on the basis of the data-side control signal Scd and applies the M data signals D(1) to D(M) to the data signal lines DL(1) to DL(M), respectively. On the other hand, in the characteristic detection mode, the data-side drive circuit 200 functions as a current measurement circuit as well as functioning as the data signal line drive circuit and measures the current in each pixel circuit 10 via the data signal line DL(j) connected thereto. As illustrated in FIG. 1, no pixel circuit is connected to the q temperature detecting data signal lines DL(k·m) (k=1 to q) among the M data signal lines DL(1) to DL(M). Hence, the q data signals D(k·m) (k=1 to q) applied to the q data signal lines DL(k·m) (k=1 to q) are not used for image display in the normal display mode but are used for writing a data voltage to each temperature detection circuit 12 in the characteristic detection mode.

The scanning-side drive circuit 400 functions as a scanning signal line drive circuit that drives the scanning signal lines GL1(1) to GL1(N) and a monitoring control line drive circuit that drives the monitoring control lines GL2(1) to GL2(N) (N=p·n+n) on the basis of the scanning-side control signal Scs from the display control circuit 100.

More specifically, in the normal display mode, as the scanning signal line drive circuit, on the basis of the scanning-side control signal Scs, the scanning-side drive circuit 400 sequentially selects the scanning signal lines GL1(1) to GL1(N) in each frame period, for each predetermined period corresponding to one horizontal period, applies an active signal (high-level voltage) to the selected scanning signal line GL1(*is*) as the scanning signal G1(*is*) (1≤is≤N), and applies an inactive signal (low-level voltage) to the non-selected scanning signal line GL1(*in*) as the scanning signal G1(*in*) (1≤in≤N and in≠is). Accordingly, the pixel circuits Pix(is, 1) to Pix(is, m−1), Pix(is, m+1) to Pix(is, 2·m−1), . . . , Pix(is, q·m+1) to Pix(is, q·m+m−1) connected to the selected scanning signal line GL1 (*is*) are collectively selected. As a result, in the selection period of the scanning signal line GL1(*is*) (hereinafter referred to as "is-scan selection period"), each of the voltages of the data signal D(1) to D(m) respectively applied to the data signal lines DL(1) to DL(M) from the data-side drive circuit 200 (hereinafter, these voltages may be simply referred to as "data voltages" without distinction) is written as pixel data to the pixel circuit Pix(is, j) connected to the data signal line DL(j) to which the voltage has been applied and the selected scanning signal line GL1(*is*). Here, with the pixel circuit 10 being not connected to the temperature detecting data signal line DL(k·m) (k=1 to q), j is any one of 1 to m−1, m+1 to 2·m−1, . . . , and q·m+1 to q·m+m−1. When the {(k−1)n+1}th scanning signal line GL1((*k*−1)n+1) is selected (k=1 to p+1), the temperature detection circuits Tmp((k−1)n+1, m), Tmp((k−1)n+1, 2·m), . . . , Tmp((k−1)n+1, q·m) are also selected. As a result, the voltages of the q data signals D(m), D(2·m), . . . , and D(q·m) respectively applied to the temperature detecting data signal lines DL(m), DL(2·m), . . . , and DL(q·m) are written as data voltages to the q temperature detection circuits Tmp((k−1)n+1, m), Tmp((k−1)n+1, 2·m), . . . , Tmp((k−1)n+1, q·m), respectively.

In the characteristic detection mode, the scanning-side drive circuit 400 selectively drives the scanning signal lines GL1(1) to GL1(N) on the basis of the scanning-side control signal Scs as the scanning signal line drive circuit and selectively drives the monitoring control lines GL2(1) to GL2(N) on the basis of the scanning-side control signal Scs as the monitoring control line drive circuit. That is, the scanning signal lines GL1(1) to GL1(N) are sequentially selected, and the monitoring control lines GL2(1) to GL2(N) are sequentially selected such that the monitoring control lines GL2(1) to GL2(N) respectively follow the sequential selection of the scanning signal lines GL1(1) to GL1(N) (see FIG. 12 to be described later). An active signal (high-level voltage) is applied to the selected monitoring control line GL2(*is*) as the monitoring control signal G2(*is*) (1 is N), and an inactive signal (low-level voltage) is applied to the non-selected monitoring control line GL2(*in*) as the monitoring control signal G2(*in*) (1≤in≤N and in≠is). Accordingly, the pixel circuits Pix(is, 1) to Pix(is, m−1), Pix(is, m+1) to Pix(is, 2·m−1), . . . , Pix(is, q·m+1) to Pix(is, q·m+m−1) connected to the selected monitoring control line GL2(*is*) are selected collectively. As a result, during the selection period (corresponding to the current measurement period) of the monitoring control line GL2(*is*), the currents respectively flowing through the selected pixel circuits Pix(is, 1) to Pix(is, m−1), Pix(is, m+1) to Pix(is, 2·m−1), . . . , Pix(is, q·m+1) to Pix(is, q·m+m−1) are taken out to the data-side drive circuit 200 via the data signal lines DL(1) to DL(m−1), DL(m+1) to DL(2·m−1), . . . , DL(q·m+1) to DL(q·m+m−1), respectively, and measured. When the {(k−1)n+1}th monitoring control line GL2((*k*−1)n+1) is selected (k=1 to p+1), the temperature detection circuits Tmp((k−1)n+1, m), Tmp((k−1)n+1, 2·m), . . . , Tmp((k−1)n+1, q·m) are also selected. As a result, the currents respectively flowing through the temperature detection circuits Tmp((k−1)n+1, m), Tmp((k−1)n+1, 2·m), . . . , Tmp((k−1)n+1, q·m) are also taken out to the data-side drive circuit 200 via the temperature detecting data signal lines DL(m), DL(2·m), . . . , DL(q·m), respectively, and measured (details will be described later).

1.2 Configuration of Pixel Circuit and Temperature Detection Circuit

Figure 3:
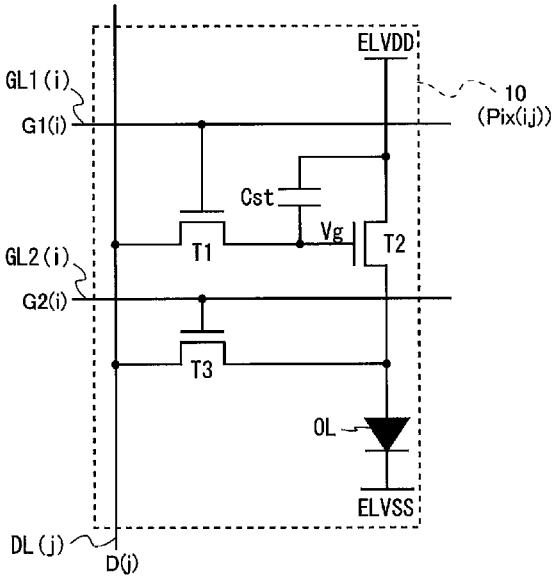
FIG. 3 is a circuit diagram illustrating an electrical configuration of a pixel circuit in the first embodiment.

FIG. 3 is a circuit diagram illustrating an electrical configuration of the pixel circuit 10 in the present embodiment, that is, a pixel circuit Pix (i, j) connected to the ith scanning signal line GL1(*i*) and the jth data signal line DL(j) (hereinafter also referred to as "the pixel circuit in the ith row and jth column"). The pixel circuit 10 includes an organic EL element OL as one light-emitting display element, three N-channel transistors, and one capacitor Cst. A transistor T1 functions as an input transistor having a gate terminal connected to the scanning signal line GL1(*i*) to select a pixel, a transistor T2 functions as a drive transistor that controls supply of a current to the organic EL element OL in accordance with a voltage held in the capacitor Cst, and a transistor T3 functions as a monitoring control transistor having a gate terminal connected to the monitoring control line GL2(*i*) to control whether or not a current measurement for detecting a characteristic of the drive transistor is performed. Note that the input transistor T1 and the monitoring control transistor T3 operate as switching elements.

As illustrated in FIG. 3, the drive transistor T2 has a drain terminal connected to the high-level power supply line ELVDD, a source terminal connected to the low-level power supply line ELVSS via the organic EL element OL, and a gate terminal connected to the data signal line DL(j) via the input transistor T1. The source terminal of the drive transistor T2 is connected to the data signal line DL(j) via the monitoring control transistor T3.

Figure 4:
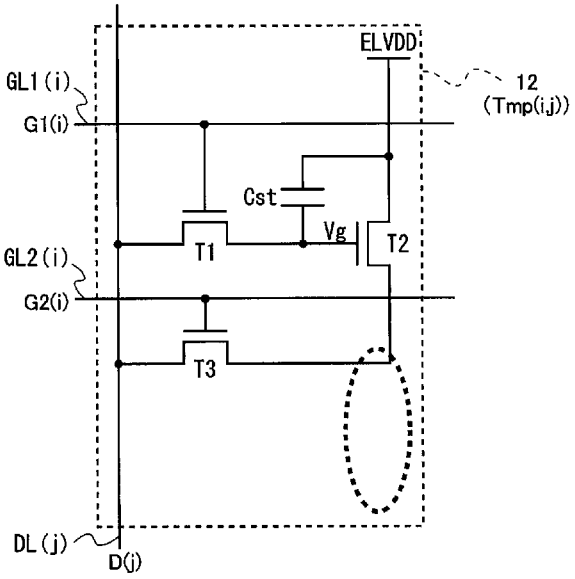
FIG. 4 is a circuit diagram illustrating an electrical configuration of a temperature detection circuit in the first embodiment.

FIG. 4 is a circuit diagram illustrating an electrical configuration of the temperature detection circuit 12 in the present embodiment, that is, a temperature detection circuit Tmp (i, j) connected to the ith scanning signal line GL1(*i*) and the jth data signal line DL(j) (hereinafter also referred to as "the temperature detection circuit in the ith row and the jth column"). The temperature detection circuit 12 has the same configuration as the pixel circuit 10 illustrated in FIG. 3 except that the organic EL element OL is not included, and includes an input transistor T1, a drive transistor T2, a monitoring control transistor T3, and a capacitor Cst. The transistor T2 in the temperature detection circuit 12 functions as a temperature detecting transistor.

Figure 5:
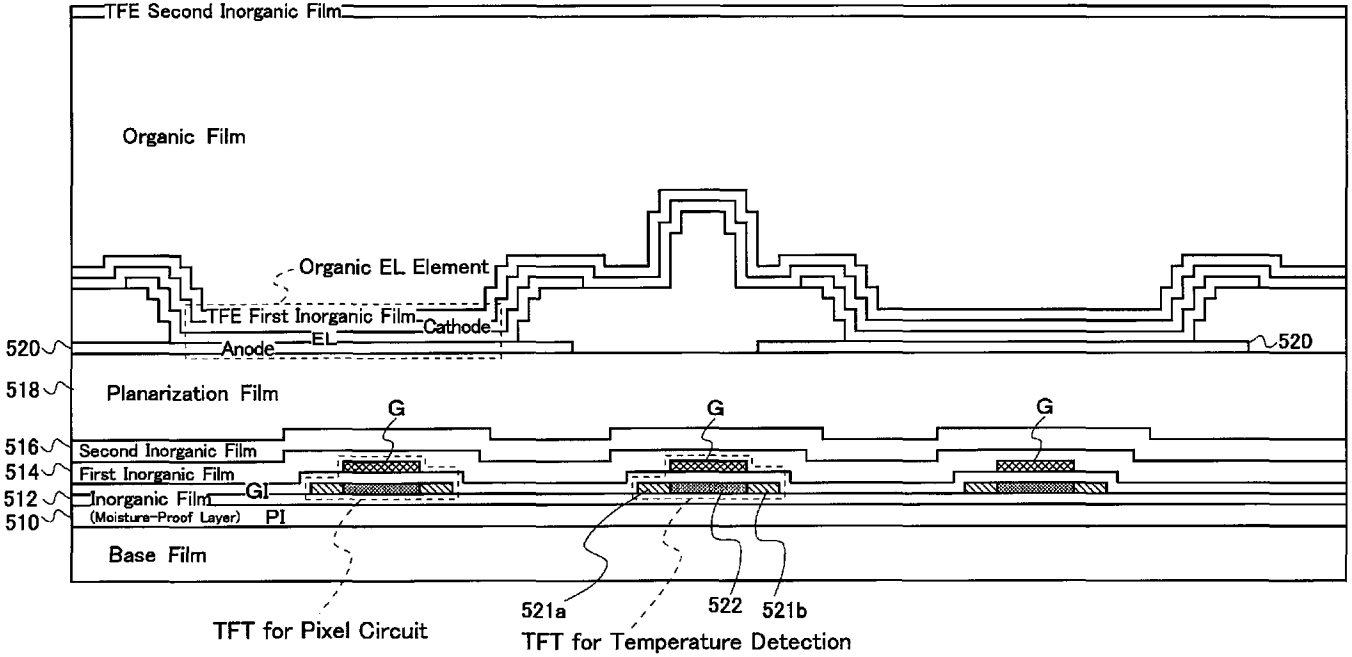
FIG. 5 is a cross-sectional view for describing an implementation example of the temperature detection circuit in the first embodiment.

FIG. 5 is a cross-sectional view for describing an implementation example of the temperature detection circuit 12 in the present embodiment. In this example, a thin-film transistor (hereinafter referred to as "temperature detecting TFT") as a component of the temperature detection circuit 12 is laminated on an inorganic film (moisture-proof film) 512 and is located below an anode 520 of the organic EL element in the pixel circuit 10, similarly to a thin-film transistor (TFT) in a pixel circuit of a top emission type organic EL display device. That is, a semiconductor layer for the temperature detecting TFT is formed on the inorganic insulating film 512 as a moisture-proof layer formed on an insulator substrate 510 formed of a glass substrate or a resin material such as polyimide. The semiconductor layer includes an intrinsic semiconductor 522 as a channel region and includes a conductor 521*a* as a source region and a conductor 521*b* as a drain region, which are formed so as to face each other with the channel region interposed therebetween. The gate insulating film GI is further formed on the semiconductor layer having such a configuration, and the gate electrode G is formed thereon. A first inorganic insulating film 514 and a second inorganic insulating film 516 are sequentially formed so as to cover the gate electrode G. Metal layers for electrical connection with other elements are formed on the second inorganic insulating film 516, and these metal layers are electrically connected to the conductor 521*a* as a source region and the conductor 521*b* as a drain region by contact holes. However, the illustration of the metal layer and the contact hole is omitted here for convenience. An insulating layer 518 as a planarization film is formed on the second inorganic insulating film 516 so as to cover a metal layer (not illustrated). By disposing the temperature detecting TFT below the anode 520 of the organic EL element in the pixel circuit 10 in this manner, an adverse effect on image display due to the formation of the temperature detection circuit 12 is avoided.

1.3 Configuration of Data-Side Drive Circuit

As illustrated in FIG. 1, the data-side drive circuit 200 according to the present embodiment includes the serial-to-parallel conversion unit 202, the DA conversion unit 204, the AD conversion unit 206, and the input/output buffer unit 208. In the normal display mode in which the display device according to the present embodiment displays an image on the basis of the input signal Sin from the outside, the data-side control signal Scd generated on the basis of the input signal Sin is provided to the data-side drive circuit 200. The data-side control signal Scd includes a digital image signal in a serial format corresponding to the image data V1, and the digital image signal in the serial format is converted into a digital image signal in a parallel format for each display row in the serial-to-parallel conversion unit 202 and latched. The latched digital image signals for one row are converted into analog voltage signals for one row by the DA conversion unit 204. The analog voltage signals for one row are subjected to impedance conversion by the input/output buffer unit 208 and then applied as M data signals D(1) to D(M) to the data signal lines DL(1) to DL(M), respectively ($M=q \cdot m+m-1$).

Figure 6:
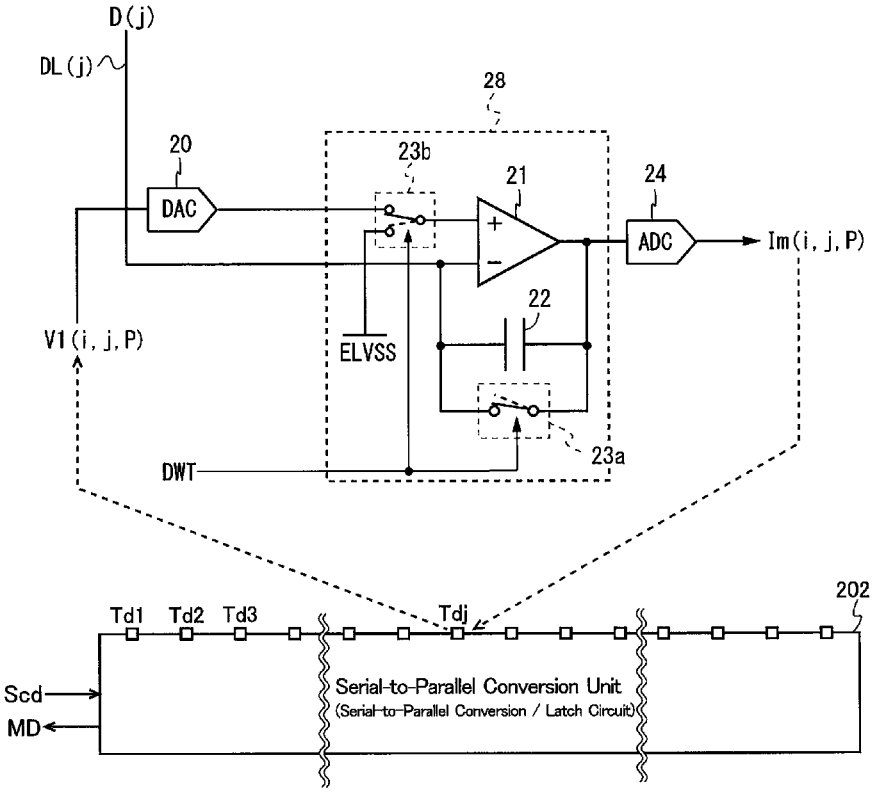
FIG. 6 is a circuit diagram for describing a detailed configuration of a data-side drive circuit in the first embodiment.

FIG. 6 is a circuit diagram for describing a detailed configuration of the data-side drive circuit 200 in the present embodiment and illustrates a detailed configuration of a portion corresponding to one data signal line DL(j) in the input/output buffer unit 208, the AD conversion unit 206, and the DA conversion unit 204 in the data-side drive circuit 200 together with the serial-to-parallel conversion unit 202. As illustrated in FIG. 6, the data-side drive circuit 200 includes an input/output buffer 28, a DA converter (DAC) 20, and an AD converter (ADC) 24 as circuit portions corresponding to one data signal line DL(j). A digital image signal Vm(i, j, P) (i=1 to N) corresponding to one pixel output from a jth terminal Tdj among the digital image signals for one row from the serial-to-parallel conversion unit 202 is sequentially input to the DA conversion unit 20. Here, the digital image signal Vm(i, j, P) is a digital signal indicating a data voltage to be given to a pixel circuit Pix(i, j) in order to display a pixel at a gradation value P in the pixel circuit Pix(i, j). The data-side control signal Scd described above includes an input/output control signal DWT in addition to the digital image signal in the serial format, and the input/output control signal DWT is input to the input/output buffer 28.

The input/output buffer 28 includes an operational amplifier 21, a capacitor 22, a first switch 23*a*, and a second switch 23*b*. An inversion input terminal of the operational amplifier 21 is connected to the data signal line DL(j), and a non-inversion input terminal of the operational amplifier 21 is connected to the second switch 23*b* as a selection switch. By the second switch 23*b*, the non-inversion input terminal of the operational amplifier 21 is connected to the output terminal of the DA conversion unit 20 when the input/output control signal DWT is at the high level (H level), and is connected to the low-level power supply line ELVSS when the input/output control signal DWT is at the low level (L level). The capacitor 22 is provided between the inversion input terminal and the output terminal of the operational amplifier 21, and the output terminal of the operational amplifier 21 is connected to the inversion input terminal of the operational amplifier 21 via the capacitor 22. The first switch 23*a* is provided between the inversion input terminal and the output terminal of the operational amplifier 21 and is connected in parallel with the capacitor 22. The capacitor 22 functions as a current-voltage conversion element. The first switch 23*a* is in an on-state when the input/output control signal DWT is at the H level, and is in an off-state when the input/output control signal DWT is at the L level. The output terminal of the operational amplifier 21 is connected to the input terminal of the AD conversion unit 24, and when the input/output control signal DWT is at the L level, a digital signal (also referred to as a "current monitoring signal") Im(i, j, P) indicating a current flowing through the data signal line DL(j) is output from the AD conversion unit 24.

In the input/output buffer 28 having such a configuration, when the input/output control signal DWT is at the H level, the first switch 23*a* is in an on-state, and the output terminal and the inversion input terminal of the operational amplifier 21 are directly connected (short-circuited). The non-inversion input terminal of the operational amplifier 21 is connected to the output terminal of the DA conversion unit 20 by the second switch 23*b*. At this time, the input/output buffer 28 functions as a voltage follower, and a digital signal Vm(i, j, P) input to the DA conversion unit 20 is converted into an analog voltage signal and provided to the data signal line DL(j) with low output impedance.

On the other hand, when the input/output control signal DWT is at the L level, the first switch 23*a* is in the off-state, and the output terminal of the operational amplifier 21 is connected to the inversion input terminal via the capacitor 22. The non-inversion input terminal of the operational amplifier 21 is connected to the low-level power supply line ELVSS by the second switch 23*b*. At this time, the operational amplifier 21 and the capacitor 22 function as an integrator. That is, the operational amplifier 21 outputs a voltage corresponding to the integrated value of the current flowing through the data signal line DL(j) connected to the inversion input terminal of the operational amplifier 21, and this voltage is converted into a digital signal by the AD conversion unit 24 and provided to a terminal Tdj of the serial-to-parallel conversion unit 202 as a current monitoring signal Im(i, j, P). At this time, since the non-inversion input terminal of the operational amplifier 21 is connected to the low-level power supply voltage ELVSS, the voltage of the data signal line DL(j) is equal to the low-level power supply voltage ELVSS due to a virtual short-circuit.

1.4 Operation

As described above, the organic EL display device according to the present embodiment has, as the operation modes, the normal display mode in which an image is displayed on the display portion 500 on the basis of the input signal Sin and the characteristic detection mode in which a current flowing through the drive transistor T2 in each pixel circuit is measured to detect transistor characteristics.

Hereinafter, first, some operation examples of the organic EL display device according to the present embodiment having these operation modes will be schematically described, and then detailed operations in the respective operation modes will be described.

In the following description, a data voltage written to the pixel circuit 10 in the ith row and the jth column, that is, the pixel circuit Pix(i, j) to display a pixel at the gradation value P in the pixel circuit Pix(i, j) is denoted by symbol "Vm(i, j, P)", similarly to the digital image signal Vm(i, j, P) indicating the data voltage. The data voltage Vm(i, j, P) is a voltage obtained by performing the threshold voltage compensation and gain compensation of the drive transistor T2 in the pixel circuit Pix(i, j) on the data voltage corresponding to the gradation value P (details will be described later with reference to FIG. 15). In addition, when the data voltage Vm(i, j, P) is written to the pixel circuit Pix(i, j) or the temperature detection circuit Tmp(i, j), the current flowing through the transistor T2 inside the circuit is denoted by symbol "Im(i, j, P)", and as described above, the measurement data MD indicating the value of the current Im(i, j, P) may also be denoted by the same symbol "Im(i, j, P)" (see FIG. 6 and FIGS. 9 and 10 to be described later). In addition, the value indicated by the measurement data Im(i, j, P) is also referred to as a "measured value Im(i, j, P)".

In the following description, "it" is used instead of "i" in a case where the row number of the temperature detection circuit 12 is distinguished from the row number of the pixel circuit 10, and "jt" is used instead of "j" in a case where the column number of the temperature detection circuit 12 is distinguished from the column number of the pixel circuit 10. Further, "ip" is used instead of "i" in a case where the row number of the pixel circuit 10 is distinguished from the row number of the image temperature detection circuit 12, and "jp" is used instead of "j" in a case where the column number of the pixel circuit 10 is distinguished from the column number of the temperature detection circuit 12.

Figure 7:
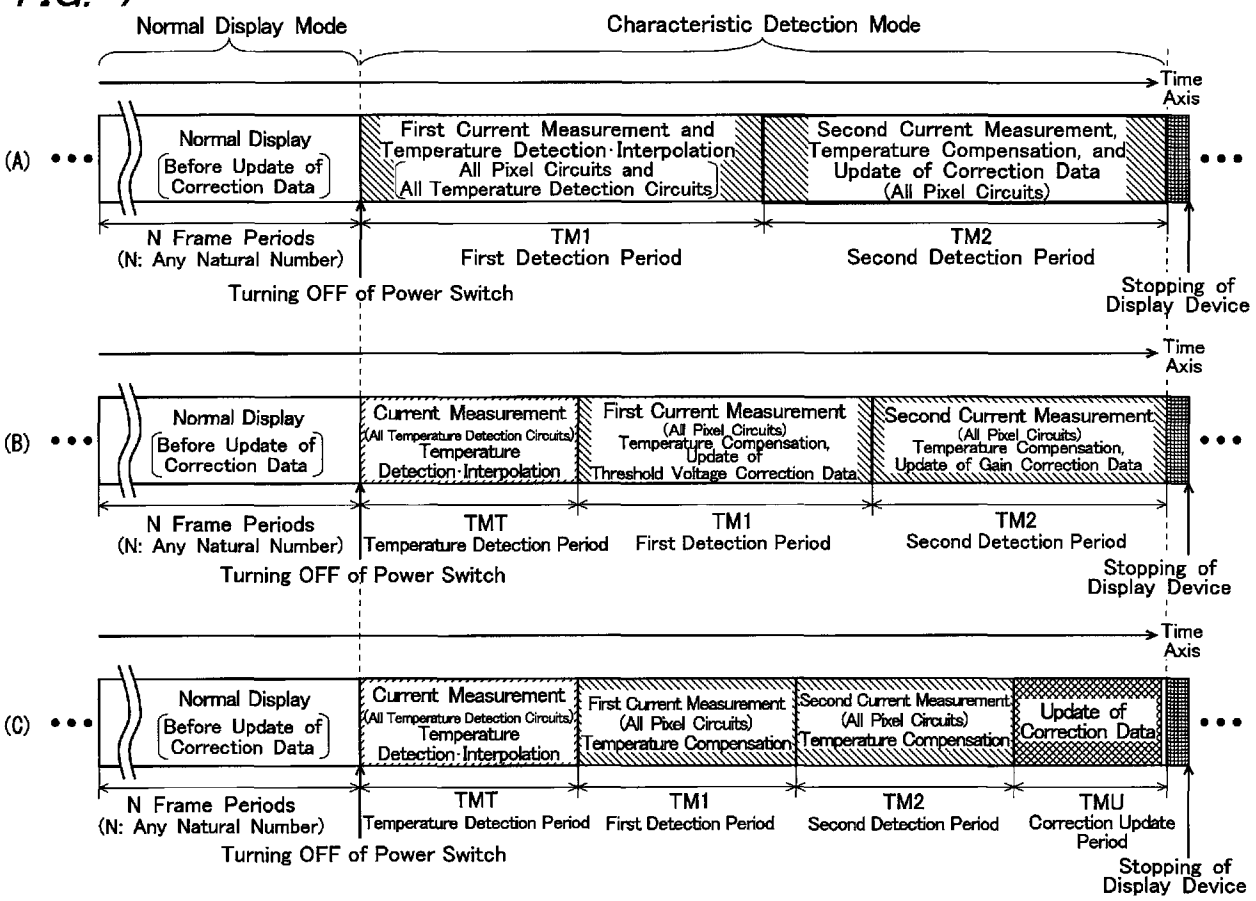
FIG. 7 provides timing charts (A), (B), and (C) illustrating operation examples of the organic EL display device according to the first embodiment.

1.4.1 First Operation Example (A) of FIG. 7 is a timing chart illustrating a first operation example of the organic EL display device according to the present embodiment. The organic EL display device according to the present embodiment operates in the normal display mode when the power switch is turned on, and switches the operation mode to the characteristic detection mode when the power switch is turned off. As illustrated in (A) of FIG. 7, in the characteristic detection mode, first, in a first detection period TM1, a data voltage Vm(i, j, P1) corresponding to a first gradation value P1 is written to each pixel circuit Pix(i, j) and each temperature detection circuit Tmp(i, j), and the current flowing through the transistor T2 is measured in each pixel circuit Pix(i, j) and each temperature detection circuit Tmp(i, j) to obtain a first measured value Im(i, j, P1). Next, a temperature Tm(it, jt) is detected on the basis of a first measured value Im(it, jt, P1), which is a measured current value obtained for each temperature detection circuit Tmp(it, jt), and an estimated temperature Tmp(ip, jp) in each pixel circuit (ip, jp) is obtained by interpolation processing based on the temperatures Tm(it, jt) of all the temperature detection circuits Tmp(it, jt). Thereafter, for each pixel circuit Pix(ip, jp), temperature compensation is performed on the first measured value Im(ip, jp, P1) by using the estimated temperature Tmp(ip, jp) to obtain a first measured temperature compensation value Imc(ip, jp, P1). Here, as can be seen from FIG. 1, "it" is any one of 1, n+1, 2n+1, . . . , and p·n+1, "jt" is any one of m, 2m, . . . , q·m, "ip" is any one of 1 to N, and "jp" is an integer except for jt among 1 to M (N=p·n+n, M=q·m+m−1).

When the first detection period TM1 in which such an operation is performed ends, a second detection period TM2 starts, and an operation as follows is performed in the second detection period TM2. First, a data voltage Vm(i, j, P2) corresponding to a second gradation value P2 is written to each pixel circuit Pix(i, j), and the current flowing through the transistor T2 is measured in each pixel circuit Pix(i, j) to obtain a second measured value Im(i, j, P2). Next, temperature compensation is performed on the second measured value Im(ip, jp, P2) by using the estimated temperature Tm(ip, jp) in each pixel circuit (ip, jp) obtained in the first detection period TM1 to obtain a second measured temperature compensation value Imc(ip, jp, P2). Thereafter, for each pixel circuit Pix(ip, jp), the correction data stored in the display control circuit 100 is updated on the basis of the first measured temperature compensation value Imc(ip, jp, P1) obtained in the first detection period TM1 and the second measured temperature compensation value Imc(ip, jp, P2) obtained in the second detection period TM2 (see FIG. 2). As the first gradation value P1 and the second gradation value P2, values that can appropriately update the correction data are selected (details will be described later). When the correction data is updated for each of all the pixel circuits Pix(ip, jp) in this manner, the second detection period TM2 ends, and the organic EL display device stops operating. In the second detection period TM2 in the present operation example, temperature detection is not performed in each temperature detection circuit Tmp(it, jt), but in the second detection period TM2 as well, the temperature in each temperature detection circuit Tmp(it, jt) may be detected by writing a data voltage to each temperature detection circuit Tmp(it, jt) and measuring the current flowing through the transistor T2 in the temperature detection circuit Tmp(it, jt). In this way, by setting the average value of the temperatures detected in the first and second detection periods TM1, TM2 for each temperature detection circuit Tmp(it, jt) as the temperature detection value, the accuracy in the temperature detection by each temperature detection circuit Tmp(it, jt) can be improved.

1.4.2 Second Operation Example (B) of FIG. 7 is a timing chart illustrating a second operation example of the organic EL display device according to the present embodiment. In the present operation example as well, the organic EL display device according to the present embodiment operates in the normal display mode when the power switch is turned on, and switches the operation mode to the characteristic detection mode when the power switch is turned off. As illustrated in (B) of FIG. 7, in the characteristic detection mode, first, in a temperature detection period TMT, a data voltage Vm(it, jt, P1) corresponding to a first gradation value P1 is written to each temperature detection circuit Tmp(it, jt), and the current flowing through the transistor T2 is measured in each temperature detection circuit Tmp(it, jt) to obtain a first measured value Im(it, jt, P1). Next, a temperature Tm(i, j) is detected on the basis of the first measured value Im(it, jt, P1) for each temperature detection circuit Tmp(it, jt), and an estimated temperature Tmp(ip, jp) in each pixel circuit (ip, jp) is obtained by interpolation processing based on the temperatures Tm(i, j) of all the temperature detection circuits Tmp(it, jt).

When the temperature detection period TMT in which such an operation is performed ends, the first detection period TM1 starts, and the following operation is performed in the first detection period TM1. First, a data voltage Vm(ip, jp, P1) corresponding to the first gradation value P1 is written to each pixel circuit Pix(ip, jp), and the current flowing through the transistor T2 is measured in each pixel circuit Pix(ip, jp) to obtain a first measured value Im(ip, jp, P1). Next, for each pixel circuit Pix(ip, jp), temperature compensation is performed on the first measured value Im(ip, jp, P1) by using the estimated temperature Tmp(ip, jp) to obtain a first measured temperature compensation value Imc(ip, jp, P1). Thereafter, for each pixel circuit Pix(ip, jp), the threshold voltage correction data Vt(ip, jp) is updated using the first measured temperature compensation value Imc(ip, jp, P1).

When the first detection period TM1 in which such an operation is performed ends, a second detection period TM2 starts, and an operation as follows is performed in the second detection period TM2. First, the data voltage Vm(ip, jp, P2) corresponding to the second gradation value P2 is written to each pixel circuit Pix(ip, jp), and the current flowing through the transistor T2 is measured in each pixel circuit Pix(ip, jp) to obtain a second measured value Im(i, j, P2). Next, for each pixel circuit Pix(ip, jp), temperature compensation is performed on the second measured value Im(ip, jp, P2) by using the estimated temperature Tmp(ip, jp) to obtain a second measured temperature compensation value Imc(ip, jp, P2). Thereafter, for each pixel circuit Pix(ip, jp), the gain correction data B2R(ip, jp) is updated using the second measured temperature compensation value Imc(ip, jp, P2).

As described above, in the present operation example, among the correction data, the threshold voltage correction data Vt(ip, jp) is updated in the first detection period TM1 on the basis of the first measured temperature compensation value Imc(ip, jp, P1), and the gain correction data B2R(ip, jp) is updated in the second detection period TM2 on the basis of the second measured temperature compensation value Imc(ip, jp, P2). When the correction data is updated for each of all the pixel circuits Pix(ip, jp) in this manner, the organic EL display device stops operating. In the first operation example, it has been necessary to temporarily store the first measured values Im(ip, jp, P1) and the like for all the pixel circuits Pix(ip.jp), but in the present operation example, it is not necessary to store such first measured values Im(ip, jp, P1) and the like. However, in the present operation example, the processing amount in the characteristic detection mode is larger than that in the first operation example.

1.4.3 Third Operation Example (C) of FIG. 7 is a timing chart illustrating a third operation example of the organic EL display device according to the present embodiment. In the present operation example as well, the organic EL display device according to the present embodiment operates in the normal display mode when the power switch is turned on, and switches the operation mode to the characteristic detection mode when the power switch is turned off. As illustrated in (C) of FIG. 7, in the characteristic detection mode, first, in the temperature detection period TMT, the estimated temperature Tmp(ip, jp) in each pixel circuit (ip, jp) is obtained by the same operation as the second operation example ((B) of FIG. 7).

When the temperature detection period TMT ends, the first detection period TM1 starts. In the first detection period TM1, the first measured temperature compensation value Imc(ip, jp, P1) is obtained using the estimated temperature Tmp(ip, jp) for each pixel circuit Pix(ip, jp) by the same operation as the first detection period TM1 in the second operation example. However, in the first detection period TM1 in the present operation example, unlike the second operation example, the correction data such as the threshold voltage correction data Vt(ip, jp) is not updated.

When the first detection period TM1 ends, the second detection period TM2 starts. In the second detection period TM2, the second measured temperature compensation value Imc(ip, jp, P2) is obtained using the estimated temperature Tmp(ip, jp) for each pixel circuit Pix(ip, jp) by the same operation as the second detection period TM2 in the second operation example. However, in the second detection period TM2 in the present operation example, unlike the second operation example, the correction data such as the threshold voltage correction data Vt(ip, jp) is not updated.

When the first and second detection periods TM1, TM2 end, a correction update period TMU starts. In the correction update period TMU, for each pixel circuit Pix(ip, jp), the threshold voltage correction data Vt(ip, jp) is updated, and the gain correction data B2R(ip, jp) is updated, using the first and second measured temperature compensation values Imc (ip, jp, P1), Imc(ip, jp, P2) (details will be described later). When the correction data is updated for each of all the pixel circuits Pix(ip, jp) in this manner, the organic EL display device stops operating.

In addition, in another operation example related to the second operation example and the third operation example, an operation as follows may be performed considering that the mode is switched from the normal display mode to the characteristic detection mode and the display panel temperature gradually decreasing with time.

In the second detection period TM2, the data voltage Vm(it, jt, P1) corresponding to the first gradation value P1 may be written to each temperature detection circuit Tmp(it, jt), and the current flowing through the transistor T2 may be measured in each temperature detection circuit Tmp(it, jt) to obtain a second measured value Im(it, jt, P1). Next, a second temperature Tm' (it, jt) may be detected on the basis of the second measured value Im(it, jt, P1) for each temperature detection circuit Tmp(it, jt), and a second estimated temperature Tmp'(ip, jp) in each pixel circuit (ip, jp) may be obtained by interpolation processing based on the second temperatures Tm' (it, jt) of all the temperature detection circuits Tmp' (it, jt). Furthermore, in the second detection period TM2, for each pixel circuit Pix(ip, jp), temperature compensation is performed on the second measured value Im(ip, jp, P2) by using the second estimated temperature Tmp'(ip, jp), to obtain the second measured temperature compensation value Imc(ip, jp, P2). As thus described, by using the second estimated temperature Tmp'(ip, jp) obtained in the second detection period TM2, it is possible to obtain the second measured temperature compensation value Imc(ip, jp, P2) with higher accuracy in consideration of the temperature decrease of the panel.

In the first operation example to the third operation example, the data voltage written to each temperature detection circuit Tmp(it, jt) during each temperature detection period may not be the same value as the data voltage Vm(it, jt, P1) corresponding to the first gradation value P1. The data voltage written to each temperature detection circuit Tmp(it, jt) during the temperature detection period may be appropriately determined in consideration of the temperature characteristic of the temperature detecting transistor T2 in the temperature detection circuit 12.

1.4.4 Detailed Operation in Normal Display Mode

Figure 8:
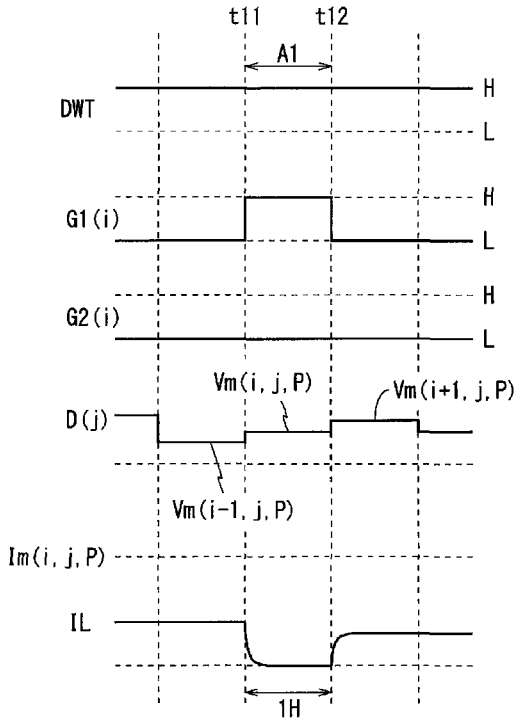
FIG. 8 is a timing chart illustrating changes of signals in a normal display mode in the first embodiment.
Figure 9:
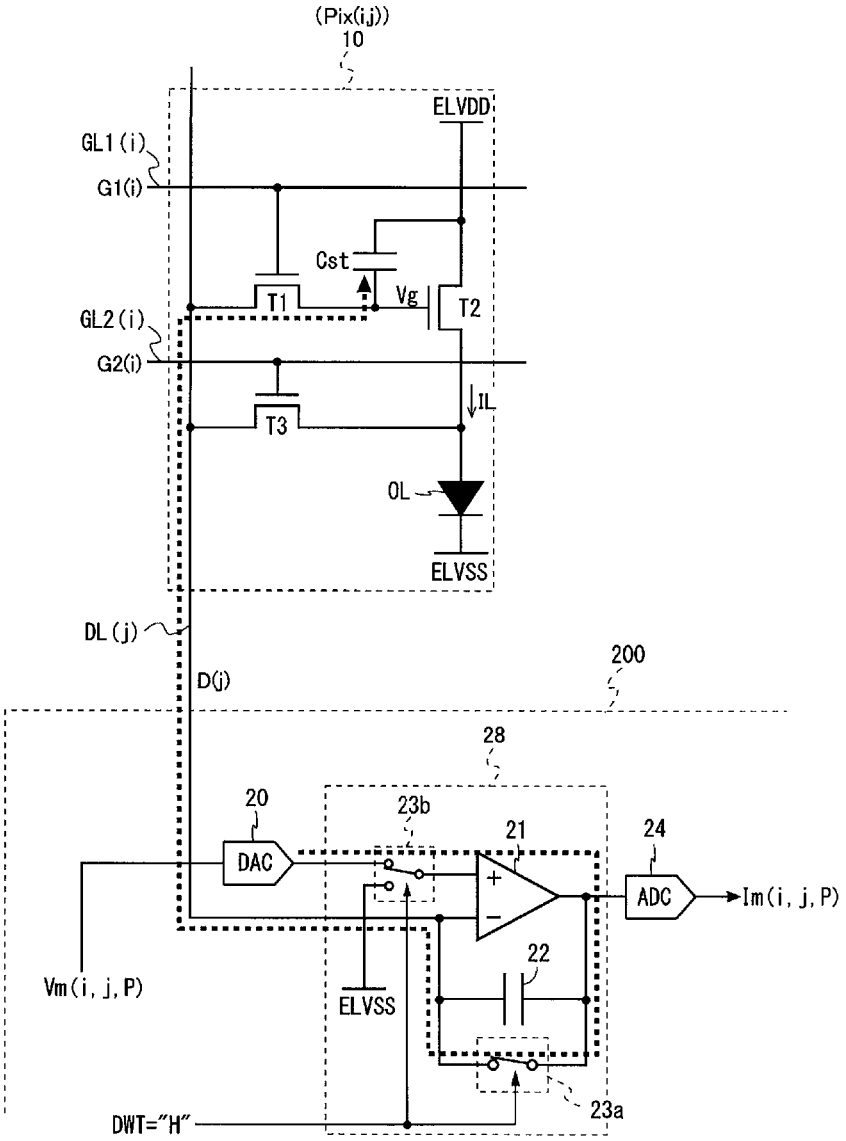
FIG. 9 is a circuit diagram illustrating a flow of a current in a program period regarding the pixel circuit in the first embodiment.
Figure 10:
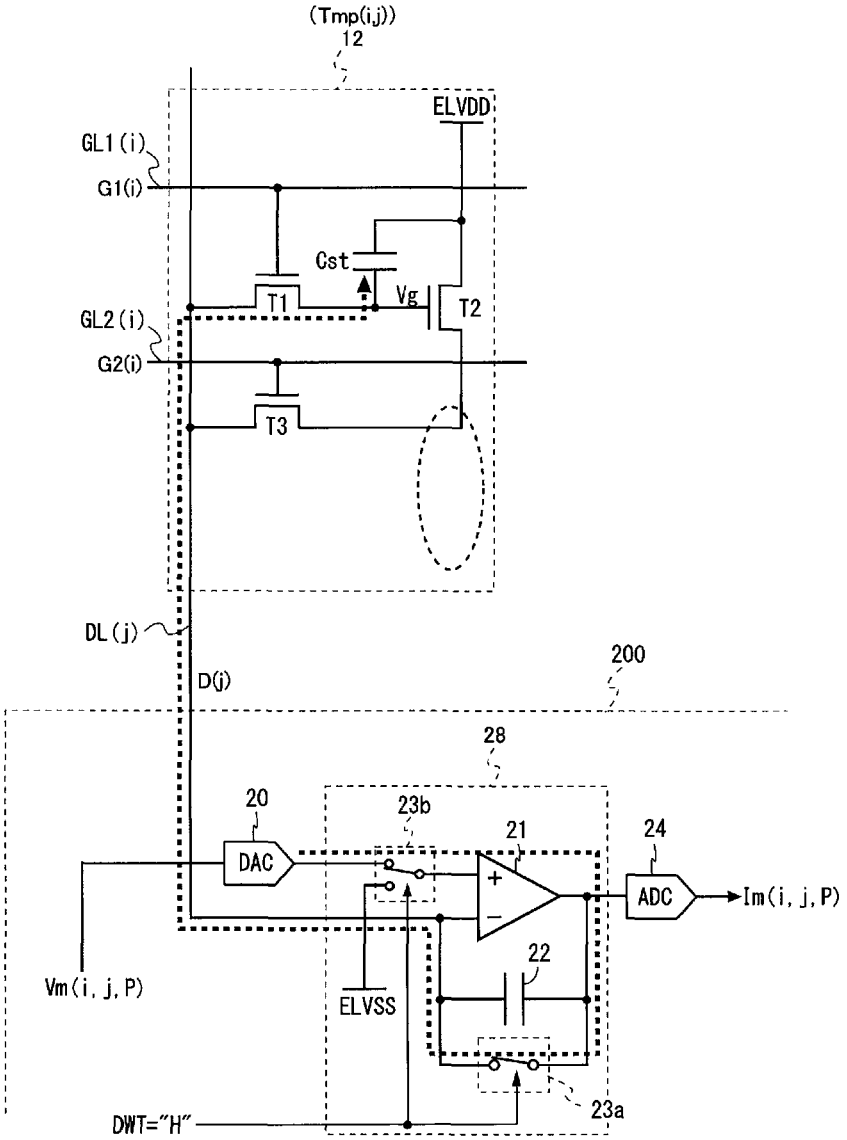
FIG. 10 is a circuit diagram illustrating a flow of a current in a program period regarding the temperature detection circuit in the first embodiment.
Figure 11:
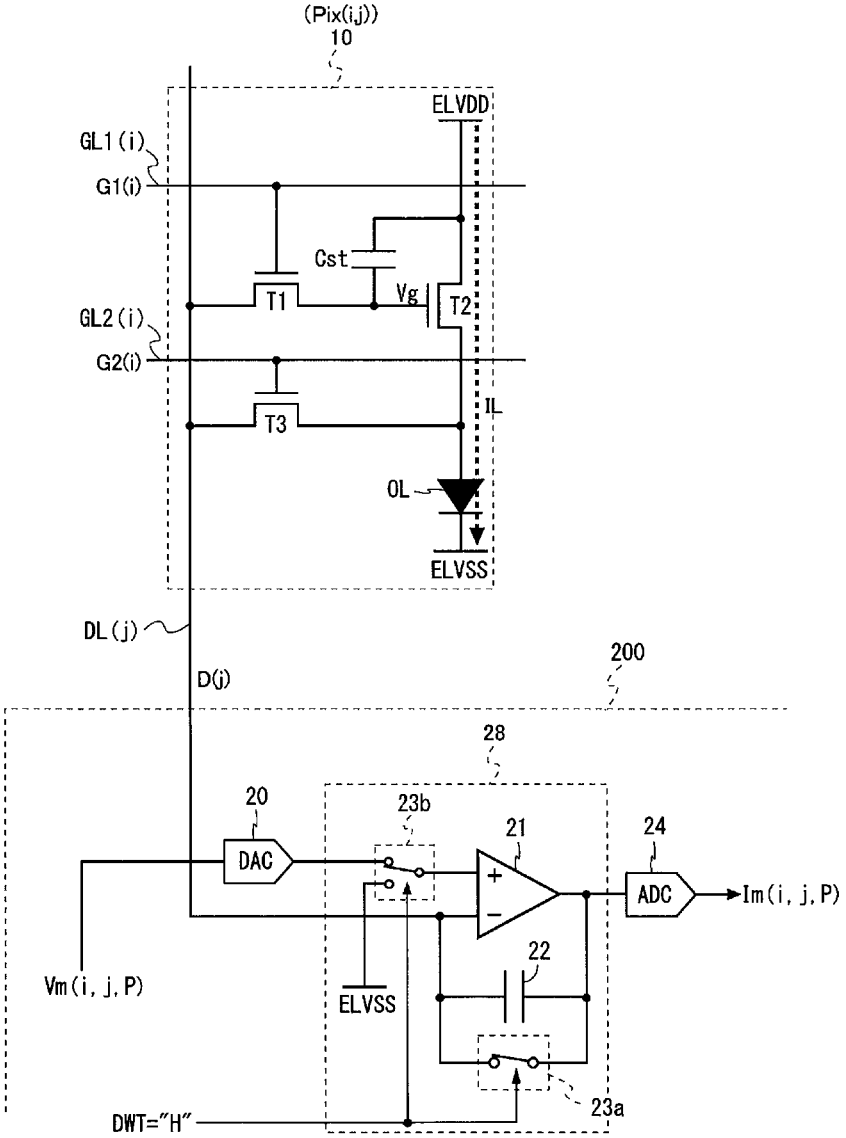
FIG. 11 is a circuit diagram illustrating a flow of a current in a light emission period in the first embodiment.

As described above, in the normal display mode, in each frame period, the scanning signal lines GL1(1) to GL1(N) are sequentially selected for each predetermined period corresponding to one horizontal period. Hereinafter, with reference to FIGS. 8 to 11, the operation in the normal display mode in the present embodiment will be described focusing on a period during which the ith scanning signal line GL1(*i*) is selected. FIG. 8 is a timing chart illustrating changes of signals in the normal display mode in the present embodiment. FIG. 9 is a diagram illustrating a flow of a current in a program period to be described later regarding the pixel circuit Pix(i, j) according to the present embodiment. FIG. 10 is a diagram illustrating a flow of a current in a program period to be described later regarding the temperature detection circuit according to the present embodiment. FIG. 11 is a diagram illustrating a flow of a current in a light emission period in the present embodiment.

As illustrated in FIG. 8, in the normal display mode, the input/output control signal DWT is always at the H level, and a monitoring control signal G2(*i*) is always at the L level. From time t11 to time t12 (hereinafter referred to as "program period A1"), the processing of writing the data voltage Vm(i, j, P) to the pixel circuit Pix(i, j) is performed.

Before time t11, the scanning signal G1(*i*) is at the L level. At this time, in the pixel circuit Pix(i, j), the transistors T1, T3 are in the off-state, and a drive current IL corresponding to the voltage held in the capacitor Cst flows through the transistor T2 and the organic EL element OL (see FIG. 11). The organic EL element OL emits light with luminance corresponding to the drive current IL at this time.

At time t11, the scanning signal G1(*i*) changes to the H level. Accordingly, the transistor T1 is turned on. In the program period A1, the data voltage Vm(i, j, P) is applied as a data signal D(j) to the data signal line DL(j) by the action of the operational amplifier 21. Thus, as illustrated in FIG. 9, the data voltage Vm(i, j, P) is applied to one end (lower terminal) of the capacitor Cst via the data signal line DL(j) and the transistor T1, and the high-level power supply voltage ELVDD is applied to the other end (upper terminal) of the capacitor Cst. Therefore, in the program period A1, the capacitor Cst is charged to the voltage Vc expressed by Expression (1) below. Here, j is an integer except for m, 2m, . . . , q·m that satisfies 1≤j≤M.

$$Vc=ELVDD-Vm(i,j,P) \tag{1}$$

When the data signal line DL(j) is a temperature detecting data signal line, and the temperature detection circuit Tmp(i, j) is connected to the scanning signal line GL1(*i*) (j is any one of m, 2m, . . . , q·m, and i is any one of 1, n+1, 2n+1, . . . , p·n+1), the capacitor Cst in the temperature detection circuit Tmp(i, j) is also charged to a voltage Vc expressed by Expression (1) above (see FIGS. 1 and 10).

At time t12, the scanning signal G1(*i*) changes to the L level. Accordingly, the transistor T1 is turned off, and the voltage Vc expressed by Expression (1) is held in the capacitor Cst. After time t12, the source terminal of the transistor T2 is electrically disconnected from the data signal line DL(j). Therefore, in the pixel circuit Pix(i, j), after the time t12, as illustrated in FIG. 11, the drive current IL flowing through the transistor T2 flows through the organic EL element OL, and the organic EL element OL emits light with luminance corresponding to the drive current IL. The transistor T2 operates in a saturation region, so that the drive current IL is given by Expression (3) below. A gain β of the transistor T2 included in Expression (3) is given by Expression (4) below.

$$\begin{aligned} IL &= (\beta/2)\times(Vgs-Vt)^2 \\ &= (\beta/2)\times\{Vm(i,\ j,\ P)-Vt\}^2 \end{aligned} \tag{3}$$

$$\beta = \mu\times(W/L)\times Cox \tag{4}$$

In Expressions (3) and (4) above, Vt, μ, W, L, and Cox represent the threshold voltage, mobility, gate width, gate length, and gate insulating film capacitance per unit area of the transistor T2, respectively. Vgs represents the gate-source voltage of the transistor T2, and when the voltage of the anode of the organic EL element OL (hereinafter referred to as "anode voltage") is Va, $$\begin{aligned} Vgs &= ELVDD - Vc - Va \\ &= Vm(i,\ j,\ P) - Va \end{aligned}$$

From the above, Expression (3) can be rewritten as follows.

$$IL=((\beta/2)\times\{Vm(i,j,P)-(Vt+Va)\}^2 \tag{3b}$$

Note that the anode voltage Va at this time corresponds to a forward voltage Vf of the organic EL element OL.

1.4.5 Detailed Operation in Characteristic Detection Mode

Figure 12:
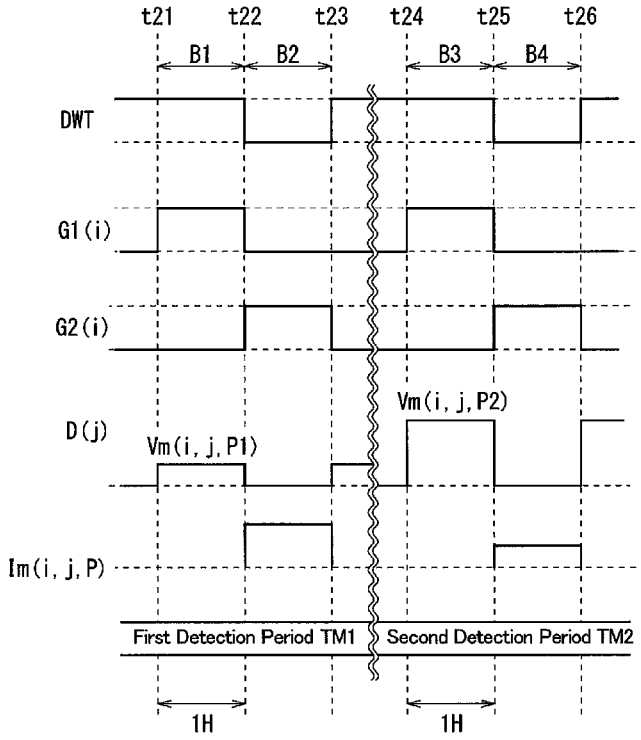
FIG. 12 is a timing chart illustrating signal changes in a characteristic detection mode in the first embodiment.
Figure 13:
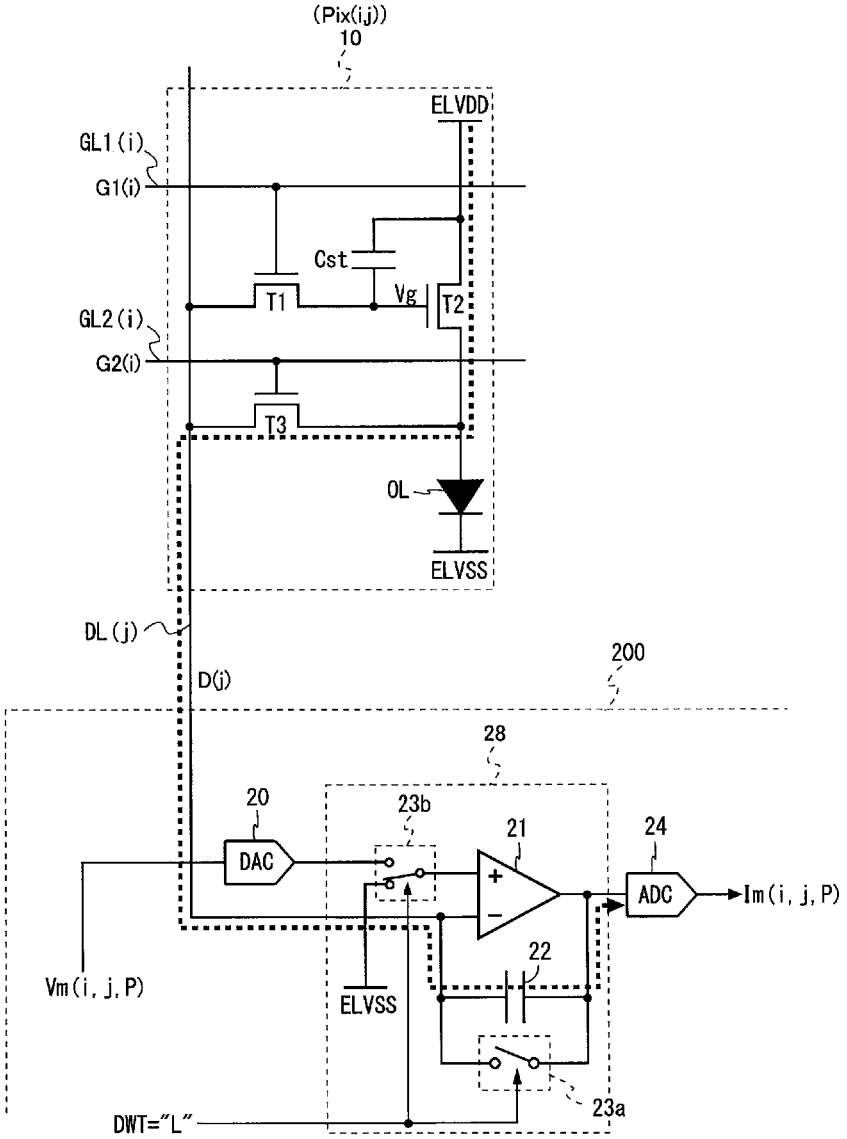
FIG. 13 is a circuit diagram illustrating a flow of a current in a current measurement period regarding the pixel circuit in the first embodiment.
Figure 14:
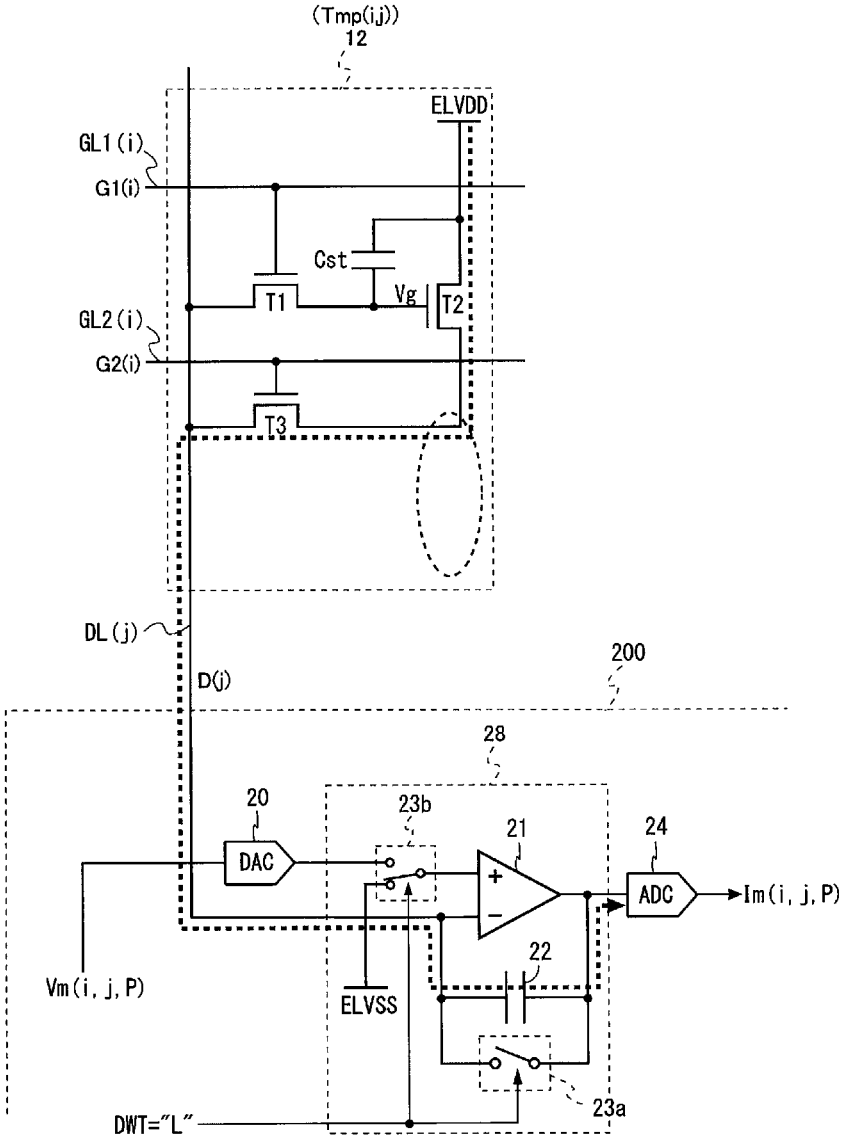
FIG. 14 is a circuit diagram illustrating a flow of a current in the current measurement period regarding the temperature detection circuit in the first embodiment.

Next, details of the first operation example ((A) of FIG. 7) in the characteristic detection mode in the present embodiment will be described. In the present operation example, in the first detection period TM1, the scanning signal lines GL1(1) to GL1(N) are sequentially selected for a predetermined period each, and the monitoring control lines GL2(1) to GL2(N) are sequentially selected for a predetermined period each, such that the monitoring control lines GL2(1) to GL2(N) follow the sequential selection of the scanning signal lines GL1(1) to GL1(N), respectively. Also, in the second detection period TM2 subsequent to the first detection period TM1, the scanning signal lines GL1(1) to GL1(N) are sequentially selected for a predetermined period each, and the monitoring control lines GL2(1) to GL2(N) are sequentially selected for a predetermined period each, such that the monitoring control lines GL2(1) to GL2(N) follow the sequential selection of the scanning signal lines GL1(1) to GL1(N), respectively. Hereinafter, with reference to FIGS. 12 to 14 together with FIGS. 9 and 10 described above, the operation in the characteristic detection mode in the present embodiment will be described focusing on the period during which the ith scanning signal line GL1(*i*) is selected and the period during which the ith monitoring control line GL2(*i*) is selected. FIG. 12 is a timing chart illustrating changes of signals in a characteristic detection mode in the present embodiment. FIG. 13 is a circuit diagram illustrating a flow of a current in a current measurement period regarding the pixel circuit 10 according to the present embodiment. FIG. 14 is a circuit diagram illustrating a flow of a current in a current measurement period regarding the temperature detection circuit 12 according to the present embodiment.

Hereinafter, the operation in the characteristic detection mode of the organic EL display device according to the present embodiment will be described focusing on the pixel circuit Pix(i, j) in the ith row and the jth column. As illustrated in FIG. 12, in the first detection period TM1, during a period from time t21 to time t22 (hereinafter referred to as "first program period B1"), the scanning signal G1(*i*) is at the H level, the transistor T1 is in the on-state, the monitoring control signal G2(*i*) is at the L level, and the transistor T3 is in the off-state, so that the processing of writing the data voltage Vm(i, j, P1) corresponding to the first gradation value P1 is performed. During a period from time t22 to time t23 (hereinafter referred to as "first measurement period B2"), the scanning signal G1(*i*) is at the L level, the transistor T1 is in the off-state, the monitoring control signal G2(*i*) is at the H level, and the transistor T3 is in the on-state, so that at this time the input/output buffer 28 operates as a current measurement circuit. As illustrated in FIG. 12, in the second detection period TM2, during a period from time t24 to time t25 (hereinafter referred to as "second program period B3"), the scanning signal G1(*i*) is at the H level, the transistor T1 is in the on-state, the monitoring control signal G2(*i*) is at the L level, and the transistor T3 is in the off-state, so that the processing of writing the data voltage Vm(i, j, P2) corresponding to the second gradation value P2 is performed. During a period from time t25 to time t26 (hereinafter referred to as "second measurement period B4"), the scanning signal G1(*i*) is at the L level, the transistor T1 is in the off-state, the monitoring control signal G2(*i*) is at the H level, and the transistor T3 is in the on-state, so that at this time the input/output buffer 28 operates as a current measurement circuit.

The first gradation value P1 and the second gradation value P2 are determined so as to satisfy P1<P2 within a range of possible gradation values of the image data V0. For example, when the range of possible gradation values of the image data V0 is 0 to 255, the first gradation value P1 is determined to be 80, and the second gradation value P2 is determined to be 160.

Hereinafter, a data voltage corresponding to the first gradation value P1 is referred to as a first measurement voltage Vm(i, j, P1), a drive current when the first measurement voltage Vm(i, j, P1) is written is referred to as a first drive current Im(i, j, P1), a data voltage corresponding to the second gradation value P2 is referred to as a second measurement voltage Vm(i, j, P2), and a drive current when the second measurement voltage Vm(i, j, P2) is written is referred to as a second drive current Im(i, j, P2). Measurement data corresponding to the first drive current Im(i, j, P1) is referred to as first measurement data and is represented as Im(i, j, P1) using the same symbol. Measurement data corresponding to the second drive current Im(i, j, P2) is referred to as second measurement data and is represented as Im(i, j, P2) using the same symbol.

As illustrated in FIG. 12, during the first program period B1 in the first detection period TM1 and the second program period B3 in the second detection period TM2, the scanning signal G1(*i*) and the input/output control signal DWT are at the H level, and during the first measurement period B2 in the first detection period TM1 and the second measurement period B4 in the second detection period TM2, the scanning signal G1(*i*) and the input/output control signal DWT are at the L level. Therefore, in the first and second program periods B1, B3, as illustrated in FIG. 9, the first switch 23*a* is turned on, and the non-inversion input terminal of the operational amplifier 21 is connected to the output terminal of the DA conversion unit 20 by the second switch 23*b*, so that the operational amplifier 21 functions as a buffer amplifier (voltage follower). In the first and second measurement periods B2, B4, as illustrated in FIG. 13, the first switch 23*a* is turned off, and the operational amplifier 21 and the capacitor 22 function as an integral amplifier. At this time, since the non-inversion input terminal of the operational amplifier 21 is connected to the low-level power supply voltage ELVSS by the second switch 23*b*, the voltage of the data signal line DL(j) is equal to the low-level power supply voltage ELVSS due to a virtual short circuit.

As illustrated in FIG. 12, at time t21, the scanning signal G1(*i*) changes to the H level, and accordingly, the transistor T2 is turned on. In the first program period B1, the first measurement voltage Vm(i, j, P1) is input to the non-inversion input terminal of the operational amplifier 21. In the first program period B1, the operational amplifier 21 functions as a buffer amplifier as described above (see FIG. 9). Thus, in the first program period B1, the first measurement voltage Vm(i, j, P1) is applied to the data signal line DL(j). Therefore, in the first program period B1, the capacitor Cst in the pixel circuit Pix(i, j) is charged to the voltage Vc expressed by Expression (5) below. Here, j is an integer except for m, 2m, . . . , q·m that satisfies 1≤j≤M.

$$Vc=ELVDD-Vm(i,j,P1) \quad (5)$$

When the data signal line DL(j) is a temperature detecting data signal line, and the temperature detection circuit Tmp(i, j) is connected to the scanning signal line GL1(*i*) (j is any one of m, 2m, . . . , q·m, and i is any one of 1, n+1, 2n+1, . . . , p·n+1), the capacitor Cst in the temperature detection circuit Tmp(i, j) is also charged to a voltage Vc expressed by Expression (5) above (see FIGS. 1 and 10).

At time t22, the scanning signal G1(*i*) and the input/output control signal DWT change to the L level. Accordingly, as illustrated in FIG. 13, the first switch 23*a* is turned off, and the operational amplifier 21 and the capacitor 22 function as an integral amplifier. In the first measurement period B2, as illustrated in FIG. 13, the non-inversion input terminal of the operational amplifier 21 is connected to the low-level power supply line ELVSS by the second switch 23*b*, so that the voltage of the inversion input terminal of the operational amplifier 21, that is, the voltage of the data signal line DL(j) becomes equal to the low-level power supply voltage ELVSS by the virtual short circuit. Hence the anode of the organic EL element OL in the pixel circuit Pix(i, j) has a voltage equal to the low-level power supply voltage ELVSS, and no current flows through the organic EL element OL.

In the first measurement period B2, with the monitoring control signal G2(*i*) being at the H level, a current path passing through the transistor T3 in the on-state is formed. In the first measurement period B2, no current flows through the organic EL element OL as described above, and the first drive current Im(i, j, P1) flowing through the transistor T2 flows through the data signal line DL(j) as illustrated in FIG. 13. The input/output buffer 28 in the data-side drive circuit 200 measures the first drive current Im(i, j, P1) flowing from the pixel circuit Pix(i, j) to the data signal line DL(j) and outputs first measurement data Im(i, j, P1) indicating the value. That is, the input/output buffer 28 functions as a current measurement circuit that measures a current flowing through (the drive transistor T2 of) the pixel circuit Pix(i, j). Here, j is an integer except for m, 2m, . . . , q·m that satisfies 1≤j≤M. Also, when the data signal line DL(j) is a temperature detecting data signal line, and the temperature detection circuit Tmp(i, j) is connected to the scanning signal line GL1(*i*) (j is any one of m, 2m, . . . , q·m, and i is any one of 1, n+1,2n+1, . . . , p·n+1), as illustrated in FIG. 14, the first drive current Im(i, j, P1) flowing through the transistor T2 of the temperature detection circuit Tmp(i, j) flows through the data signal line DL(j). Therefore, the input/output buffer 28 in the data-side drive circuit 200 similarly measures the first drive current Im(i, j, P1) and outputs first measurement data Im(i, j, P1) indicating the value. At this time, the input/output buffer 28 functions as a current measurement circuit that detects a current flowing through the transistor T2 of the temperature detection circuit Tmp(i, j).

The operations of the pixel circuit Pix(i, j) and the data-side drive circuit 200 in the second program period B3 are similar to the operations in the first program period B1. The operations of the temperature detection circuit Tmp(i, j) and the data-side drive circuit 200 in the second program period B3 when the data signal line DL(j) is a temperature detecting data signal line and the temperature detection circuit Tmp(i, j) is connected to the scanning signal line GL1(*i*) are also similar to the operations in the first program period B1. The operations of the pixel circuit Pix(i, j) and the data-side drive circuit 200 in the second measurement period B4 are similar to those in the first measurement period B2. The operations of the temperature detection circuit Tmp(i, j) and the data-side drive circuit 200 in the second measurement period B4 when the data signal line DL(j) is a temperature detecting data signal line and the temperature detection circuit Tmp(i, j) is connected to the scanning signal line GL1(*i*) is also similar to the operations in the first measurement period B2. However, the second measurement voltage Vm(i, j, P2) is written to the pixel circuit Pix(i, j) and the temperature detection Tmp(i, j) in the second program period B3, the second drive current Im(i, j, P2) is measured in the second measurement period B4, and the second measurement data Im(i, j, P2) indicating the value is output.

As described above, in the characteristic detection mode in the present embodiment, at the timing as illustrated in FIG. 12, in the first detection period TM1, the scanning signal lines GL1(1) to GL1(N) are sequentially selected, in accordance with which the monitoring control lines GL2(1) to GL2(N) are also sequentially selected, and in the second detection period TM2, the scanning signal lines GL1(1) to GL1(N) are sequentially selected, in accordance with which, the monitoring control lines GL2(1) to GL2(N) are also sequentially selected. However, instead of this, the first detection period TM1 and the second detection period TM2 may be integrated into one detection period, and in the one detection period, each scanning signal line GL1(*i*) may be selected twice, in accordance with which each monitoring control line GL2(*i*) may also be selected twice, thereby acquiring first and second measurement data Im(i, j, P1), Im(i, j, P2).

1.5 Correction Processing

Figure 15:
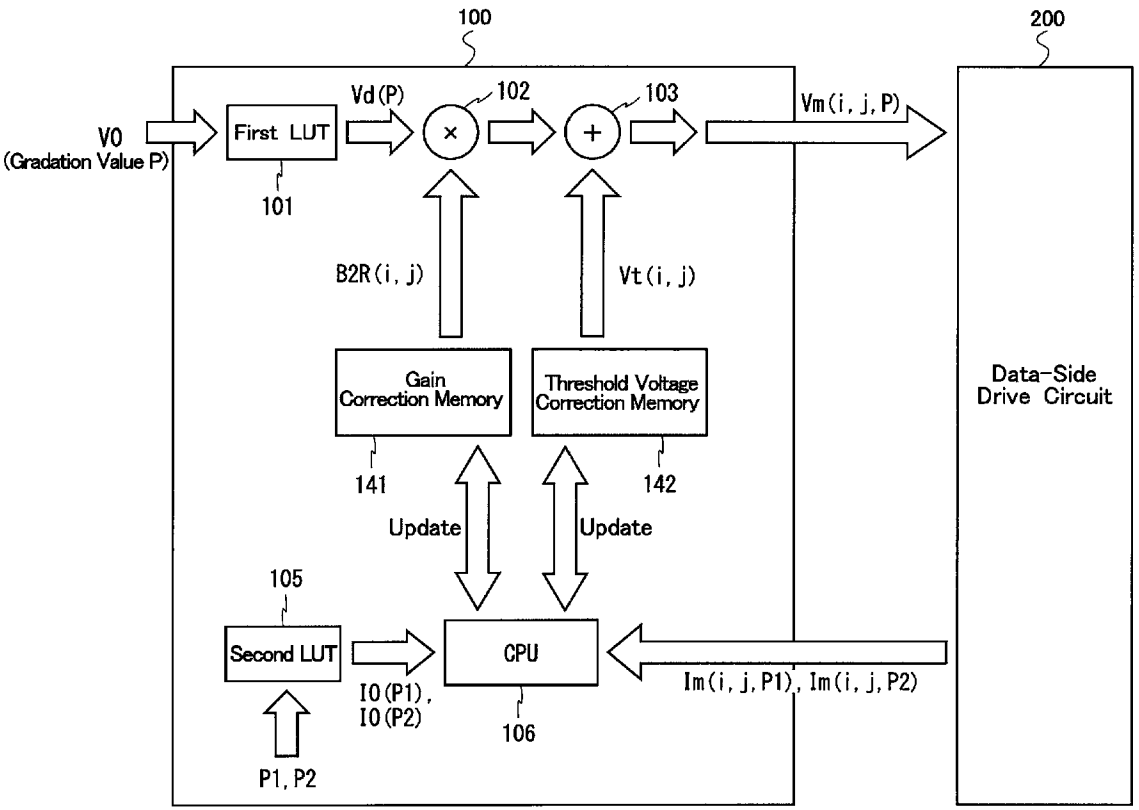
FIG. 15 is a block diagram illustrating correction processing in the first embodiment.

Next, correction processing for performing external compensation in the present embodiment (hereinafter, simply referred to as "correction processing") will be described. FIG. 15 is a block diagram for describing the correction processing in the present embodiment and illustrates a configuration of a portion of the display control circuit 100 that performs correction processing for compensating for variations and deterioration in characteristics (here, gain and threshold voltage) of the drive transistor T2 in each pixel circuit Pix(i, j). Note that the portion of the display control circuit 100 that performs the correction constitutes an external compensation circuit together with the data-side drive circuit 200 having a function of measuring the current flowing through (the drive transistor of) each pixel circuit 10 in the characteristic detection mode.

The display control circuit 100 uses a part of the storage region of the RAM 140 as the gain correction memory 141 and uses another part of the storage region of the RAM 140 as the threshold voltage correction memory 142 (see FIG. 2). The gain correction memory 141 stores data (hereinafter referred to as "gain correction data") for performing gain compensation on the drive transistor T2 in the pixel circuit 10. The threshold voltage correction memory 142 stores data (hereinafter referred to as "threshold voltage correction data") indicating the value of the threshold voltage of the drive transistor T2 in the pixel circuit 10. Further, the display control circuit 100 uses still another part of the storage region of the RAM 140 as the working memory 143.

As illustrated in FIG. 1, in the present embodiment, N×(M−q) pixel circuits 10 are arranged in a matrix on the display portion 500 (N=(p+1)n, M=q·m+m−1). In correspondence with the N×(M−q) pixel circuits 10, the gain correction memory 141 stores N×(M−q) pieces of gain correction data, and the threshold voltage correction memory 142 stores N×(M−q) pieces of threshold voltage correction data. Hereinafter, the gain correction data corresponding to the pixel circuit Pix(i, j) is represented as B2R(i, j), and the threshold voltage correction data corresponding to the pixel circuit Pix(i, j) is represented as Vt(i, j). In the initial state, all pieces of the gain correction data B2R(i, j) are set to "1", and all pieces of the threshold voltage correction data Vt(i, j) are set to the same value. Thereafter, the correction data B2R(i, j) and the correction data Vt(i, j) are updated by characteristic compensation processing to be described later in the characteristic detection mode (see FIGS. 18 and 19).

As illustrated in FIG. 15, the display control circuit 100 includes a first look up table (LUT) 101, a multiplier 102, an adder 103, a subtractor 104, a second LUT 105, and a CPU 106. Instead of the CPU 106, a logic circuit corresponding to the characteristic compensation processing illustrated in FIG. 18 to be described later may be used.

1.5.1 Correction Processing in Normal Display Mode

The first LUT 101 stores the possible gradation values of the image data V0, included in the input signal Sin, and voltage values in association with each other. In the normal display mode, when the gradation value of image data V0 in the input signal Sin from the outside is P, the first LUT 101 outputs a voltage value Vd(P) corresponding to the gradation value P. The multiplier 102 multiplies the voltage value Vd(P) output from the first LUT 101 by a gain correction data B2R(i, j) read from the gain correction memory 141. The adder 103 adds the output of the multiplier 102 and a threshold voltage correction data Vt(i, j) read from the threshold voltage correction memory 142 and outputs the obtained value as image data Vm(i, j, P). The image data Vm(i, j, P) is given by Expression (6) below.

$$Vm(i,j,P)=Vd(P)\times B2R(i,j)+Vt(i,j) \tag{6}$$

When Expression (6) is substituted into Expression (3b), Expression (7) below is derived.

$$IL=(\beta/2)\times\{Vd(P)\times B2R(i,j)+Vt(i,j)-(Vt+Va)\}^2 \tag{7}$$

Therefore, by changing the gain correction data B2R(i, j) and the threshold voltage correction data Vt(i, j) in accordance with the state of the drive transistor T2, both the threshold voltage compensation and the gain compensation can be performed for each pixel circuit 10. Here, the threshold voltage compensation means compensation for the voltage Vt+Va including not only the threshold voltage Vt of the drive transistor T2 but also the anode voltage Va corresponding to the forward voltage Vf of the organic EL element OL.

The image data Vm(i, j, P) is temporarily held in, for example, a buffer memory (not illustrated) and then sent from the display control circuit 100 to the data-side drive circuit 200 under the control of the CPU 106. Thereafter, by using such image data Vm(i, j, P) for each pixel circuit Pix(i, j), the image indicated by the input signal Sin is displayed on the display portion 500 by the above-described operations of the data-side drive circuit 200 and the scanning-side drive circuit 400 in the normal display mode (see FIGS. 8, 9, and 11).

1.5.2 Correction Processing in Characteristic Detection Mode

In the correction processing in the present embodiment, in the characteristic detection mode, the correction data (the threshold voltage correction data and the gain correction data) is updated on the basis of the current monitoring result subjected to temperature compensation. Hereinafter, correction processing in such a characteristic detection mode will be described.

The first LUT 101 performs the following conversion on the gradation value P. It is assumed that a current flowing through the organic EL element OL when the organic EL element OL emits light at the maximum luminance is Iw, and a gate-source voltage Vgs of the drive transistor T2 at that time is given by Expression (8) below. In the following description, it is assumed that the gradation value P is normalized to a value in a range of 0 to 1.

$$Vgs=Vw+Vt \tag{8}$$

In this case, the first LUT 101 performs, for example, conversion expressed by Expression (9) below.

$$Vd(P)=Vw\times P^{1.1} \tag{9}$$

When the voltage Vd(P) expressed by Expression (9) is used, a drive current IL(P) corresponding to the gradation value P is given by Expression (10) below. It is assumed that B2R(i, j)=1 and Vt(i, j)=Vt.

$$IL(P)=(\beta/2)\times Vw^2\times P^{2.2} \tag{10}$$

Hence the drive current IL has a characteristic of $\gamma=2.2$ with respect to the gradation value P. Since the light emission luminance of the organic EL element OL is proportional to the drive current IL, the light emission luminance of the organic EL element OL also has a characteristic of $\gamma=2.2$ with respect to the gradation value Pn.

In the characteristic detection mode, the second LUT 105 converts the first gradation value P1 into a first ideal characteristic value IO(P1) expressed by Expression (12) below, and converts the second gradation value P2 into a second ideal characteristic value IO(P2) expressed by Expression (13) below. In the following description, it is assumed that the first gradation value P1 and the second gradation value P2 are also normalized to values in a range of 0 to 1.

$$IO(P1)=Iw\times P1^{2.2} \tag{12}$$

$$IO(P2)=Iw\times P2^{2.2} \tag{13}$$

In the characteristic detection mode, image data Vm(i, j, P1) based on the first gradation value P1 and image data Vm(i, j, P2) based on the second gradation value are sent to the data-side drive circuit 200 in the same manner as described above. The CPU 106 receives the first measurement data Im(i, j, P1) and the second measurement data Im(i, j, P2) from the data-side drive circuit 200 as the current measurement data corresponding to the image data Vm(i, j, P1) and Vm(i, j, P2). As can be seen from FIG. 1, among the first and second measurement data Im(i, j, P1), Im(i, j, P2), the first and second measurement data in which i is any one of 1, n+1, 2n+1, . . . , p·n+1 and j is any one of m, 2m, . . . , q·m indicate measured values of the current flowing through the transistor T2 in the temperature detection circuit Tmp(i, j). In the present embodiment, a temperature Tm(i, j) in the temperature detection circuit Tmp(i, j) is obtained using a first measured value of the current flowing through the transistor T2 in each temperature detection circuit Tmp(i, j). In the following description as well, "it" is used instead of "i" in a case where the row number of the temperature detection circuit 12 is distinguished from the row number of the pixel circuit 10, and "jt" is used instead of "j" in a case where the column number of the temperature detection circuit 12 is distinguished from the column number of the pixel circuit 10. Further, "ip" is used instead of "i" in a case where the row number of the pixel circuit 10 is distinguished from the row number of the temperature detection circuit 12, and "jp" is used instead of "j" in a case where the column number of the pixel circuit 10 is distinguished from the column number of the temperature detection circuit 12.

Figure 16:
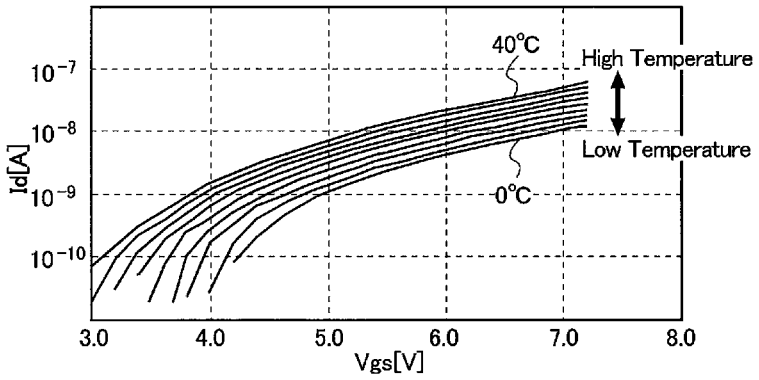
FIG. 16 is a characteristic diagram illustrating the temperature dependency of a voltage-current characteristic of a transistor included in a temperature detection circuit in the first embodiment.

FIG. 16 is a characteristic diagram illustrating the temperature dependency of the voltage-current characteristic of the transistor T2 included in the temperature detection circuit Tmp(it, jt) in the present embodiment (hereinafter referred to as "transistor temperature characteristic") (a change in the temperature characteristic due to variations in the threshold voltage and the gain of the transistor T2 is assumed to be small and negligible). For example, the temperature Tm(it, jt) of the temperature detection circuit Tmp(it, jt) can be obtained on the basis of the characteristic diagram of FIG. 16 from the first measured value Im(it, jt, P1) of the current flowing through the transistor T2 of the temperature detection circuit Tmp(it, jt) when the data voltage Vm(it, jt, P1) is written to the temperature detection circuit Tmp(it, jt). In the present embodiment, the temperature Tm(it, jt) of each temperature detection circuit Tmp(it, jt) obtained in this manner is used to perform temperature compensation on the current monitoring result for each pixel circuit Pix(ip, jp), that is, two measured current values made up of the first measured value Im(ip, jp, P1) and the second measured value Im(ip, jp, P2), and the variations and deterioration in the characteristics (threshold voltage and gain) of the drive transistor T2 in each pixel circuit 10 are compensated by the external compensation method using the current monitoring result subjected to temperature compensation. Hereinafter, a description will be given of the characteristic compensation processing of the pixel circuit 10 including the temperature compensation for the current monitoring result as thus described, that is, characteristic compensation processing of the drive transistor in the pixel circuit 10 (hereinafter referred to as "transistor characteristic compensation processing" or simply "characteristic compensation processing").

The temperature Tm(i, j) of each temperature detection circuit Tmp(i, j) in the present embodiment is obtained as follows.

Using the RAM 140 or the flash memory 150, it is possible to create a lookup table (hereinafter abbreviated as "LUT") that associates the temperature Tm with the combination of the gate-source voltage Vgs of the transistor T2 and a drain current Id in the temperature detection circuit 12 on the basis of the transistor temperature characteristic illustrated in FIG. 16, and an LUT that associates a temperature compensation coefficient (hereinafter, simply referred to as "temperature compensation coefficient") rc for the measured current value with the combination of the gate-source voltage Vgs of the transistor in the pixel circuit 10 and the estimated temperature Tmp of the pixel circuit 10. On the other hand, assuming that the data voltage to be written to each pixel circuit Pix(i, j) or each temperature detection circuit Tmp(i, j) is denoted by Vm(i, j, P), in the current measurement period of the characteristic detection mode, the gate-source voltage Vgs of the transistor T2 in the pixel circuit Pix(i, j) or the temperature detection circuit Tmp(i, j) is Vgs=Vm(i, j, P)−Va (see FIGS. 13 and 14). The drain current Id of the transistor T2 corresponds to the measured value Im(i, j, P) of the current of the pixel circuit Pix(i, j) or the temperature detection circuit Tmp(i, j) to which the data voltage Vm(i, j, P) has been written.

Therefore, in the present embodiment, the RAM 140 or the flash memory 150 is used to achieve a third LUT 108, which associates the temperature Tm(it, jt) with the combination of the first measured value Im(it, jt, P1) of the temperature detection circuit Tmp(it, jt) and the corresponding data voltage Vm(it, jt, P1), and a fourth LUT 109, which associates a temperature compensation coefficient rc with the combination of the estimated temperature Tmp(ip, jp) of the pixel circuit Pix(ip, jp) determined from the temperature Tm(it, jt) of each temperature detection circuit Tmp(ip, jp) and the data voltage Vm(ip, jp, P1) to be written to the pixel circuit Pix(ip, jp). That is, the third LUT 108 and the fourth LUT 109 are created in advance using the RAM 140 or the flash memory 150 on the basis of the transistor temperature characteristic illustrated in FIG. 16. As described above, since the first measured value Im(it, jt, P1) of the temperature detection circuit Tmp(it, jt) is measured by the input/output buffer 28 functioning as a current measurement circuit in the data-side drive circuit 200, a temperature measurement circuit that measures the temperature Tm(it, jt) of the temperature detection circuit Tmp(i, j) is achieved by the input/output buffer 28 and the third LUT 108 (see FIGS. 14, 16, and 17). In addition, when the data voltage to be written to the temperature detection circuit Tmp(i, j) is constant, the input/output buffer 28 having a function of measuring the current flowing through the temperature detection circuit Tmp(i, j) can be regarded as a temperature measurement circuit.

Here, the temperature compensation coefficient rc is a coefficient to be multiplied by the first and second measured values Im(ip, jp, P1), Im(ip, jp, P2) in order to obtain a current value at a predetermined standard temperature (e.g., 25° C.) for each pixel circuit (ip, jp). In the present embodiment, the fourth LUT 109 is also created on the basis of the temperature characteristic of FIG. 16, assuming that the pixel circuit Pix(ip, jp) and the temperature detection circuit Tmp(it, jt) are regarded as having substantially the same temperature characteristic of the transistor T2, but instead of this, a similar temperature characteristic of the transistor T2 of the pixel circuit Pix(ip, jp) may be examined in advance, and the fourth LUT 109 may be created on the basis of the temperature characteristic.

Figure 17:
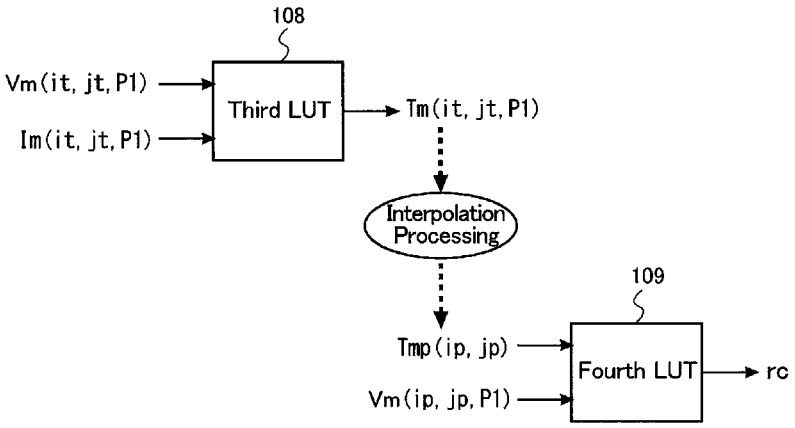
FIG. 17 is a block diagram for describing temperature compensation for a measured current value in the first embodiment.
Figure 18:
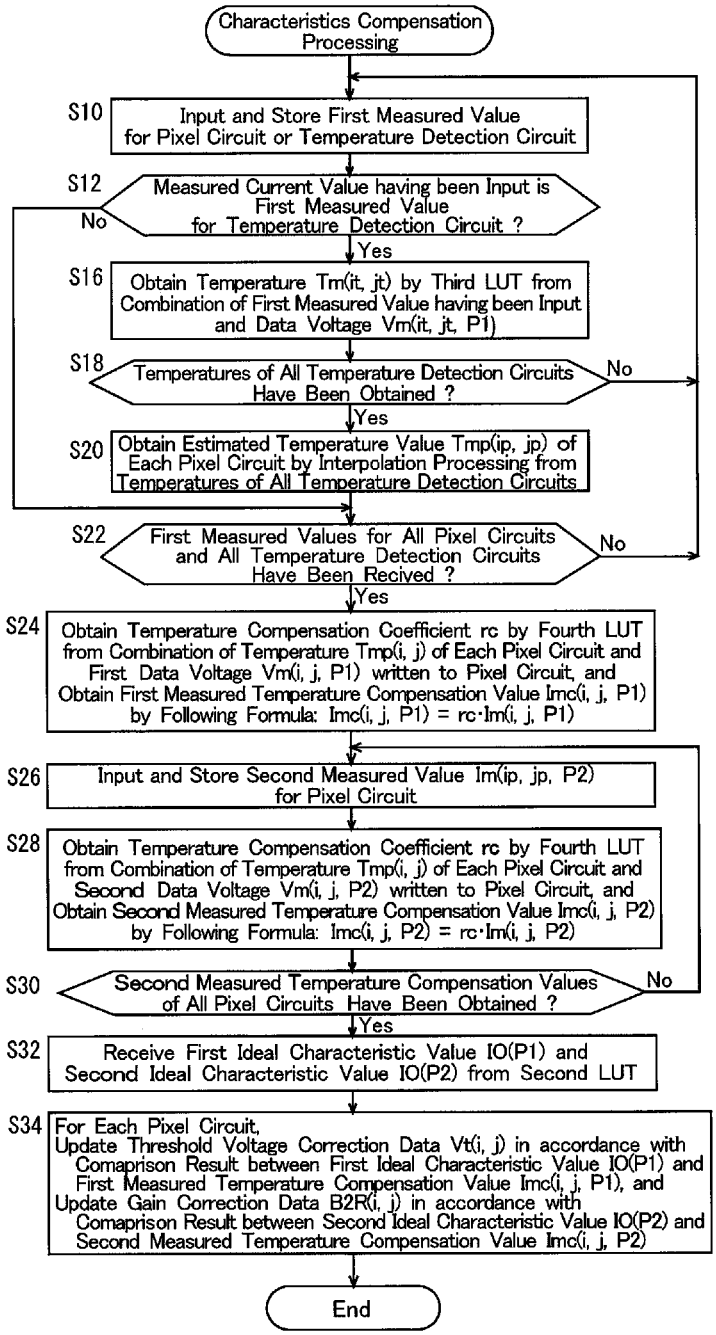
FIG. 18 is a flowchart illustrating transistor characteristic compensation processing in the first embodiment.

FIG. 17 illustrates the third and fourth LUTs 108, 109, and the CPU 106 compensates for the temperature dependency of the first and second measured values Im(ip, jp, P1), Im(ip, jp, P2) for each pixel circuit 10, that is, the temperature dependency of the current monitoring result by the temperature compensation processing using the third and fourth LUTs 108, 109. The transistor characteristic compensation processing in the present embodiment includes the temperature compensation processing for the current monitoring result as thus described. FIG. 18 is a flowchart illustrating transistor characteristic compensation processing for one screen based on the first operation example ((A) of FIG. 7) in the present embodiment. In this transistor characteristic compensation processing, the CPU 106 operates as follows by loading a predetermined program stored in the flash memory 150 to the RAM 140 and executing the program.

First, on the basis of the operation illustrated in FIG. 12, the first measured value Im(i, j, P1), which is a measured current value for the pixel circuit 10 and the temperature detection circuit 12, is sequentially received from the data-side drive circuit 200, and the received measured current value (hereinafter also referred to as "measured input value") is temporarily stored into the working memory 143 in the RAM 140 (step S10). Here, it is assumed that one measured input value is received by one execution of step S10 and temporarily stored into the working memory 143.

Next, it is determined whether or not the measured current value (measured input value) input in the immediately preceding step S10 is the first measured value for the temperature detection circuit 12 (step S12). As a result of this determination, when the measured input value is the first measured value for the temperature detection circuit 12, the processing proceeds to step S16, and when the measured input value is not the first measured value for the temperature detection circuit 12, that is, when the measured input value is the first measured value for the pixel circuit 10, the processing proceeds to step S22.

In step S16, the temperature Tm(it, jt) of the temperature detection circuit Tmp(it, jt) is obtained by the third LUT 108 from the combination of the first measured value Im(it, jt, P1), which is the measured input value, and the data voltage Vm(it, jt, P1) corresponding thereto. Next, it is determined whether or not the temperatures of all the temperature detection circuits 12 have been obtained in step S16 (step S18). As a result of this determination, when the temperature of any of the temperature detection circuits 12 has not been obtained, the processing returns to step S10, and when the temperatures of all the temperature detection circuits 12 have been obtained, the processing proceeds to step S20.

In step S20, the estimated temperature Tmp(ip, jp) of each pixel circuit Pix(ip, jp) is obtained from the temperature Tm(it, jt) obtained for all the temperature detection circuits 12 by interpolation processing based on the arrangement of the pixel circuit 10 and the temperature detection circuit 12 illustrated in FIG. 1. This interpolation processing corresponds to the estimation of the temperature distribution in the display portion 500 on the basis of the temperatures Tm(it, jt) obtained for each of all the temperature detection circuits 12.

Thereafter, in step S22, it is determined whether or not the first measured values for all the pixel circuits 10 and all the temperature detection circuits 12 have been received. As a result of this determination, when the first measured values for all the pixel circuits 10 and all the temperature detection circuits 12 have not been received, that is, when the first measured value for any of the pixel circuits 10 or any of the temperature detection circuits 12 has not been received, the processing returns to step S10. Thereafter, steps S10 to S22 are repeatedly executed until all the first measured values for all the pixel circuits 10 and all the temperature detection circuits 12 are received, and when it is determined in step S22 that all the first measured values for all the pixel circuits 10 and all the temperature detection circuits 12 are received, the processing proceeds to step S24.

At the point in time when the processing proceeds to detections step S24, since the estimated temperature Tmp(i, j) of each pixel circuit Pix(i, j) has been obtained (see step S20), for each pixel circuit Pix(i, j), the temperature compensation coefficient rc is obtained by the fourth LUT 109 from the combination of an estimated temperature Tmp(i, j) of the pixel circuit and a first data voltage Vm(i, j, P1) written to the pixel circuit. Then, the first measured value Im(i, j, P1) of the pixel circuit is multiplied by the temperature compensation coefficient rc to obtain a first measured temperature compensation value Imc(i, j, P1). That is, $$Imc(i,j,P1)=rc\cdot Im(i,j,P1) \tag{14}$$

As described above, the first measured temperature compensation value Imc(i, j, P1) indicates a measured current value when a drain current with respect to the first gradation value P1 of the drive transistor T2 in the pixel circuit is measured at a standard temperature (25° C.)

After receiving the first measured values for all the pixel circuits 10 and all the temperature detection circuits 12, the CPU 106 sequentially receives the second measured values Im(ip, jp, P2) for all the pixel circuits 10. When receiving one second measured value for the pixel circuit 10 in step S26, the CPU 106 temporarily stores the second measured value into the working memory 143 and proceeds to step S28.

In step S28, for each pixel circuit Pix(i, j), the temperature compensation coefficient rc is obtained by the fourth LUT 109 from the combination of the estimated temperature Tmp(i, j) of the pixel circuit and the second data voltage Vm(i, j, P2) written to the pixel circuit. Then, the second measured value Im(i, j, P2) of the pixel circuit is multiplied by the temperature compensation coefficient rc to obtain a second measured temperature compensation value Imc(i, j, P2). That is, $$Imc(i,j,P2)=rc\cdot Im(i,j,P2) \tag{15}$$

The second measured temperature compensation value Imc (i, j, P2) indicates a measured current value when a drain current with respect to the second gradation value P2 of the drive transistor T2 in the pixel circuit is measured at a standard temperature (25° C.)

Thereafter, it is determined whether or not the second measured temperature compensation values Imc(i, j, P2) of all the pixel circuits 10 have been obtained (step S30). As a result of this determination, when the second measured temperature compensation value Imc(i, j, P2) of any of the pixel circuits 10 has not been obtained, the processing returns to step S26, and when the second measured temperature compensation values Imc(i, j, P2) of all the pixel circuits 10 have been obtained, the processing proceeds to step S32.

In step S32, the first ideal characteristic value IO(P1) and the second ideal characteristic value IO(P2) are received from the second LUT 105 described above (see FIG. 15).

Thereafter, for each pixel circuit Pix(i, j), the threshold voltage correction data Vt(i, j) is updated in accordance with the comparison result between the first ideal characteristic value IO(P1) and the first measured temperature compensation value Imc(i, j, P1) (step S34). That is, ΔV is added to the threshold voltage correction data Vt(i, j) when Expression (16) below holds, ΔV is subtracted from the threshold voltage correction data Vt(i, j) when Expression (17) below holds, and the threshold voltage correction data Vt(i, j) is not updated when Expression (18) below holds. Note that ΔV is a predetermined fixed value.

$$IO(P1)-Imc(i,j,P1)>0 \tag{16}$$

$$IO(P1)-Imc(i,j,P1)<0 \tag{17}$$

$$IO(P1)-Imc(i,j,P1)=0 \tag{18}$$

In step S34, for each pixel circuit Pix(i, j), the gain correction data B2R(i, j) is updated in accordance with the comparison result between the second ideal characteristic value IO(P2) and the second measured temperature compensation value Imc(i, j, P2). That is, AB is added to the gain correction data B2R(i, j) when Expression (19) below is satisfied, ΔB is subtracted from the gain correction data B2R(i, j) when Expression (20) below is satisfied, and the gain correction data B2R(i, j) is not updated when Expression (21) below is satisfied. Note that ΔB is a predetermined fixed value.

$$IO(P2)-Imc(i,j,P2)>0 \tag{19}$$

$$IO(P2)-Imc(i,j,P2)<0 \tag{20}$$

$$IO(P2)-Imc(i,j,P2)=0 \tag{21}$$

When the threshold voltage correction data Vt(i, j) and the gain correction data B2R(i, j) are updated for each of all the pixel circuits in this manner, the characteristic compensation processing ends.

1.6 Effects

In the organic EL display device employing the external compensation method as in the present embodiment, the data voltage Vd(P) corresponding to each gradation value P of the image data V0 included in the input signal Sin is corrected on the basis of the correction data (threshold voltage correction data Vt(i, j) and gain correction data B2R(i, j)) stored for each pixel circuit (see FIG. 15), whereby the variations and deterioration in the characteristics (threshold voltage, gain) of the drive transistor T2 in each pixel circuit Pix(i, j) are compensated. For such external compensation, the current flowing through the drive transistor of each pixel circuit Pix(i, j), to which each of the data voltages (Vm(i, j, P1), Vm(i, j, P2)) corresponding to the predetermined gradation value (P1, P2) has been written, is measured (see FIG. 13), and the correction data is updated on the basis of the measured current value (Im(i, j, P1), Im(i, j, P2)) obtained by the measurement (see FIGS. 15 and 18). In the present embodiment, the data voltage is also written to the temperature detection circuit Tmp(it, jt) provided in the display portion 500, the current flowing through the transistor T2 of the temperature detection circuit Tmp(it, jt) is measured (see FIG. 14), and the temperature Tm(it, jt) is obtained on the basis of the measurement result. The estimated temperature Tmp(ip, jp) of each pixel circuit Pix(ip, jp) is obtained from each temperature Tm(it, jt) obtained in this manner. Temperature compensation is performed on the measured current values (Im(i, j, P1), Im(i, j, P2)) on the basis of each obtained estimated temperature Tmp(ip, jp), whereby first and second measured temperature compensation values Imc(i, j, P1), Imc(i, j, P2) are obtained. Such first and second measured temperature compensation values Imc (i, j, P1), Imc(i, j, P2) are used to update the correction data (FIG. 17, FIG. 18).

Therefore, according to the present embodiment, even when the temperature of each pixel circuit changes in accordance with the display content immediately before the organic EL display device shifts from the normal display mode to the characteristic detection mode, it is possible to accurately compensate for variations and deterioration in the characteristics (threshold voltage and gain) of the drive transistor T2. That is, unlike the known example in which the current measurement for external compensation is performed after the lapse of a long time for equalizing the temperature of the display portion 500, even immediately after the image display on the display portion 500, accurate transistor characteristic compensation in consideration of the temperature distribution on the display portion at that time can be performed. Further, in the present embodiment, a circuit for detecting a temperature for each pixel circuit is not provided, but a smaller number of temperature detection circuits 12 than before are used to consider the temperature distribution in the display portion 500, so that it is possible to compensate for the transistor characteristics. (see FIG. 1) As described above, according to the present embodiment, in the organic EL display device, it is possible to perform accurate external compensation in consideration of the temperature distribution in the display portion while preventing the configuration from being complicated.

In the present embodiment, when the second gradation value P2 is higher than the first gradation value P1, the pixel circuit may generate heat in the second detection period TM2, and a temperature difference may occur between the first detection period TM1 and the second detection period TM2. According to the present embodiment, even in such a case, it is possible to perform external compensation with higher accuracy by obtaining the temperature in each of the first and second detection periods TM1, TM2 and correcting the measured value of the drive current in the pixel circuit (temperature compensation) (see FIG. 12).

Figure 19:
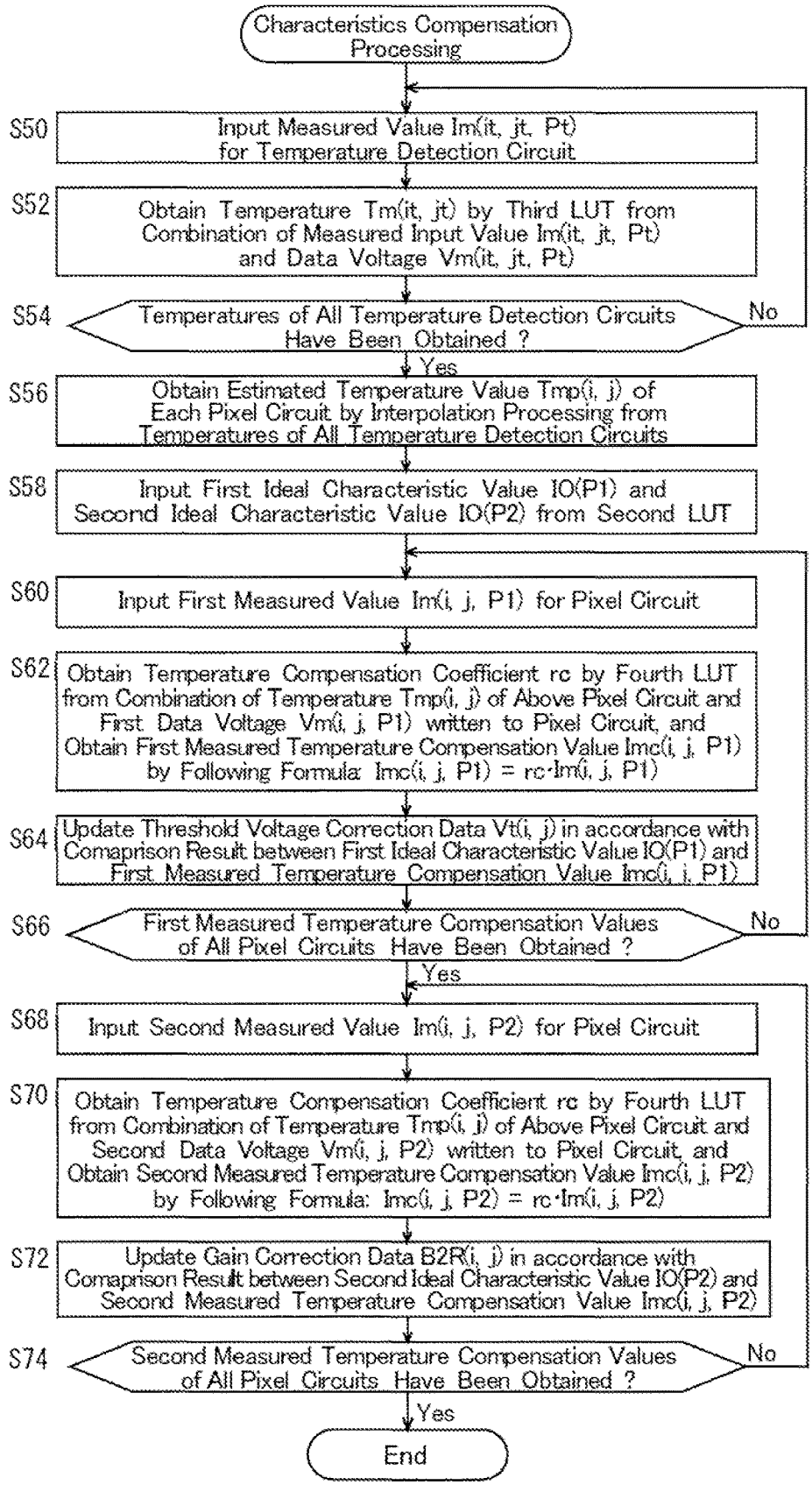
FIG. 19 is a flowchart illustrating another example of transistor characteristic compensation processing in the first embodiment.

1.7 Another Example of Characteristic Compensation Processing in First Embodiment FIG. 18 illustrates the characteristic compensation processing based on the first operation example ((A) of FIG. 7), but characteristic compensation processing based on the second operation example ((B) of FIG. 7) or the third operation example ((C) of FIG. 7) may be performed instead of the characteristic compensation processing of FIG. 18. For example, the characteristic compensation processing based on the second operation example ((B) of FIG. 7) is specifically processing as illustrated in FIG. 19. FIG. 19 is a flowchart illustrating transistor characteristic compensation processing for one screen in the second operation example of the present embodiment. In this transistor characteristic compensation processing, the CPU 106 operates as follows by loading a predetermined program stored in the flash memory 150 to the RAM 140 and executing the program.

As can be seen from (B) of FIG. 7, in the second operation example, from the data-side drive circuit 200, the CPU 106 first sequentially receives the measured values Im(it, jt, Pt) of the currents in all the temperature detection circuits 12, then sequentially receives the first measured values Im(ip, jp, P1) in all the pixel circuits 10, and then sequentially receives the second measured values Im(ip, jp, P2) in all the pixel circuits 10.

First, in step S50, when receiving one measured value Im(it, jt, Pt), the CPU 106 obtains the temperature Tm(it, jt) of the temperature detection circuit Tmp(it, jt) by the third LUT 108 from the combination of the received measured value (hereinafter referred to as "measured input value") Im(it, jt, Pt) and the data voltage Vm(it, jt, Pt) corresponding thereto. Next, it is determined whether or not the temperatures of all the temperature detection circuits 12 have been obtained in the immediately preceding step S50 (step S52). As a result of this determination, when the temperature of any of the temperature detection circuits 12 has not been obtained, the processing returns to step S50, and when the temperatures of all the temperature detection circuits 12 have been obtained, the processing proceeds to step S56.

In step S56, the estimated temperature Tmp(ip, jp) of each pixel circuit Pix(ip, jp) is obtained from the temperature Tm(it, jt) obtained for all the temperature detection circuits 12 by interpolation processing based on the arrangement of the pixel circuit 10 and the temperature detection circuit 12 illustrated in FIG. 1.

Next, the first ideal characteristic value IO(P1) and the second ideal characteristic value IO(P2) are received from the second LUT 105 described above (step S58) (see FIG. 15).

Thereafter, when the first measured value Im(i, j, P1) of any of the pixel circuits 10 is received from the data-side drive circuit 200 in step S60, the temperature compensation coefficient rc is obtained by the fourth LUT 109 from the combination of the estimated temperature Tmp(i, j) of the pixel circuit 10 and the data voltage Vm(i, j, P1) corresponding to the first measured value Im(i, j, P1). Then, the first measured value Im(i, j, P1) of the pixel circuit 10 is multiplied by the temperature compensation coefficient rc to obtain a first measured temperature compensation value Imc(i, j, P1). That is, $$Imc(i,j,P1)=rc\cdot Im(i,j,P1) \tag{14}$$

Next, as in step S34 in FIG. 18, for each pixel circuit Pix(i, j), the threshold voltage correction data Vt(i, j) is updated in accordance with the comparison result between the first ideal characteristic value IO(P1) and the first measured temperature compensation value Imc(i, j, P1) (step S64).

Thereafter, it is determined whether or not the first measured temperature compensation values Imc(i, j, P1) of all the pixel circuits 10 have been obtained (step S66). As a result of this determination, when the first measured temperature compensation value Imc(i, j, P1) of any of the pixel circuits 10 has not been obtained, the processing returns to step S60, and when the first measured temperature compensation values Imc(i, j, P1) of all the pixel circuits 10 have been obtained, the processing proceeds to step S68.

When the second measured value Im(i, j, P2) of any of the pixel circuits 10 is received from the data-side drive circuit 200 in step S68, the temperature compensation coefficient rc is obtained by the fourth LUT 109 from the combination of the estimated temperature Tmp(i, j) of the pixel circuit 10 and the data voltage Vm(i, j, P2) corresponding to the second measured value Im(i, j, P2). Then, the second measured value Im(i, j, P2) of the pixel circuit 10 is multiplied by the temperature compensation coefficient rc to obtain a second measured temperature compensation value Imc(i, j, P2). That is, $$Imc(i,j,P2)=rc\cdot Im(i,j,P2) \tag{15}$$

Next, as in step S34 in FIG. 18, for each pixel circuit Pix(i, j), the gain correction data B2R(i, j) is updated in accordance with the comparison result between the second ideal characteristic value IO(P2) and the second measured temperature compensation value Imc(i, j, P2) (step S72).

Thereafter, it is determined whether or not the second measured temperature compensation value Imc(i, j, P2) of all the pixel circuits 10 have been obtained (step S74). As a result of this determination, when the second measured temperature compensation value Imc(i, j, P2) of any of the pixel circuits 10 has not been obtained, the processing returns to step S68, and when the second measured temperature compensation values Imc(i, j, P2) of all the pixel circuits have been obtained, the characteristic compensation processing ends.

In the characteristic compensation processing based on each of the first and second operation examples ((A) and (B) of FIG. 7), the update of the correction data includes the update of the threshold voltage correction data Vt(i, j) based only on the first measured temperature compensation value Imc(i, j, P1) and the update of the gain correction data B2R(i, j) based only on the second measured temperature compensation value Imc(i, j, P2) (step S34 in FIG. 18 and steps S64 and S72 in FIG. 19). In contrast, in the characteristic compensation processing based on the third operation example ((C) in FIG. 7), the correction data is updated as follows on the basis of both the first measured temperature compensation value Imc(i, j, P1) and the second measured temperature compensation value Imc(i, j, P2).

In the third operation example illustrated in (C) of FIG. 7, for each pixel circuit Pix(i, j), in the first detection period TM1, after the first measured value Im(i, j, P1) is obtained, temperature compensation is performed on the measured value to obtain the first measured temperature compensation value Imc(i, j, P1), and in the second detection period TM2, after the second measured value Im(i, j, P2) is obtained, temperature compensation is performed on the measured value to obtain the second measured temperature compensation value Imc(i, j, P2). More specifically, in the first detection period TM1, the drive current (the current flowing through the drive transistor T2) obtained by writing a first measuring gradation voltage Vmp1 calculated by Expression (21) below as pixel data to the pixel circuit Pix(i, j) is measured, and in the second detection period TM2, the drive current obtained by writing a second measuring gradation voltage Vmp2 calculated by Expression (22) below as pixel data to the pixel circuit Pix(i, j) is measured.

$$Vmp1=Vcw\times Vn(P1)\times B(i,j)+Vth(i,j) \tag{21}$$

$$Vmp2=Vcw\times Vn(P2)\times B(i,j)+Vth(i,j) \tag{22}$$

Here, Vcw is a difference between a gradation voltage corresponding to the minimum gradation and the gradation voltage corresponding to the maximum gradation (i.e., a range of the gradation voltage). Vn (P1) is a value obtained by normalizing the first gradation value P1 to a value in the range of 0 to 1, and Vn (P2) is a value obtained by normalizing the second gradation value P2 to a value in the range of 0 to 1. B (i, j) is a normalization coefficient for the pixel circuit Pix(i, j) in the ith row and the jth column calculated by Expression (23) below. Vth (i, j) is an offset value for the pixel circuit Pix(i, j) in the ith row and the jth column.

$$B=\sqrt{(\beta 0/\beta)} \tag{23}$$

Here, β0 is an average value of gain values for all the pixel circuits 10, and β is a gain value for the pixel circuit Pix(i, j) in the ith row and the jth column. After the measurement of the drive current based on the first and second gradation values P1, P2 is performed as described above, temperature compensation is performed on the measured value, and the offset value Vth and the gain value β are calculated on the basis of the measured value after the temperature compensation. In these calculations, Expression (24) below indicating the relationship between the drain current (drive current) Id and the gate-source voltage Vgs of the drive transistor T2 is used.

$$Id=(\beta/2)\times(Vgs-Vth)^2 \tag{24}$$

Specifically, an offset value Vth expressed by Expression (25) below and a gain value β expressed by Expression (26) below are obtained from a simultaneous equation consisting of an equation in which a measurement result (value after temperature compensation) based on the first gradation value P1 is substituted into Expression (24) above and an equation in which a measurement result (value after temperature compensation) based on the second gradation value P2 is substituted into Expression (24) above.

$$Vth=\{Vgsp2\sqrt{(IOp1)}-Vgsp1\sqrt{(IOp2)}\}/\{\sqrt{(IOp1)}-\sqrt{(IOp2)}\} \tag{25}$$

$$\beta=2\{\sqrt{(IOp1)}-\varepsilon(IOp2)\}^2/(Vgsp1-Vgsp2)^2 \tag{26}$$

Here, IOp1 is a drive current (value after temperature compensation) as a measurement result based on the first gradation value P1 and corresponds to the first measured temperature compensation value Imc(i, j, P1), and IOp2 is a drive current (value after temperature compensation) as a measurement result based on the second gradation value P2 and corresponds to the second measured temperature compensation value Imc(i, j, P2). In addition, Vgsp1 is a gate-source voltage based on the first gradation value P1, and Vgsp2 is a gate-source voltage based on the second gradation value P2. As described above, in the present embodiment, the source terminal of the drive transistor T2 in the pixel circuit Pix(i, j) in which the drive current is measured is maintained at the low-level power supply voltage ELVSS (see FIG. 13). In the following, it is assumed that this low-level power supply voltage ELVSS is "0". In this case, Vgsp1 is given by Expression (27) below, and Vgsp2 is given by Expression (28) below.

$$Vgsp1=Vmp1 \tag{27}$$

$$Vgsp2=Vmp2 \tag{28}$$

For each pixel circuit Pix(i, j), the threshold voltage correction data Vt(i, j) in the threshold voltage correction memory 142 and the gain correction data B2R(i, j) in the gain correction memory 141 are updated using the offset value Vth and the gain value β calculated as described above (see FIG. 2). Note that the offset value Vth corresponds to the threshold voltage correction data Vt(i, j), and the normalization coefficient B=√/β0/β) given by Expression (23) above corresponds to the gain correction data B2R(i, j).

2. Second Embodiment

Figure 20:
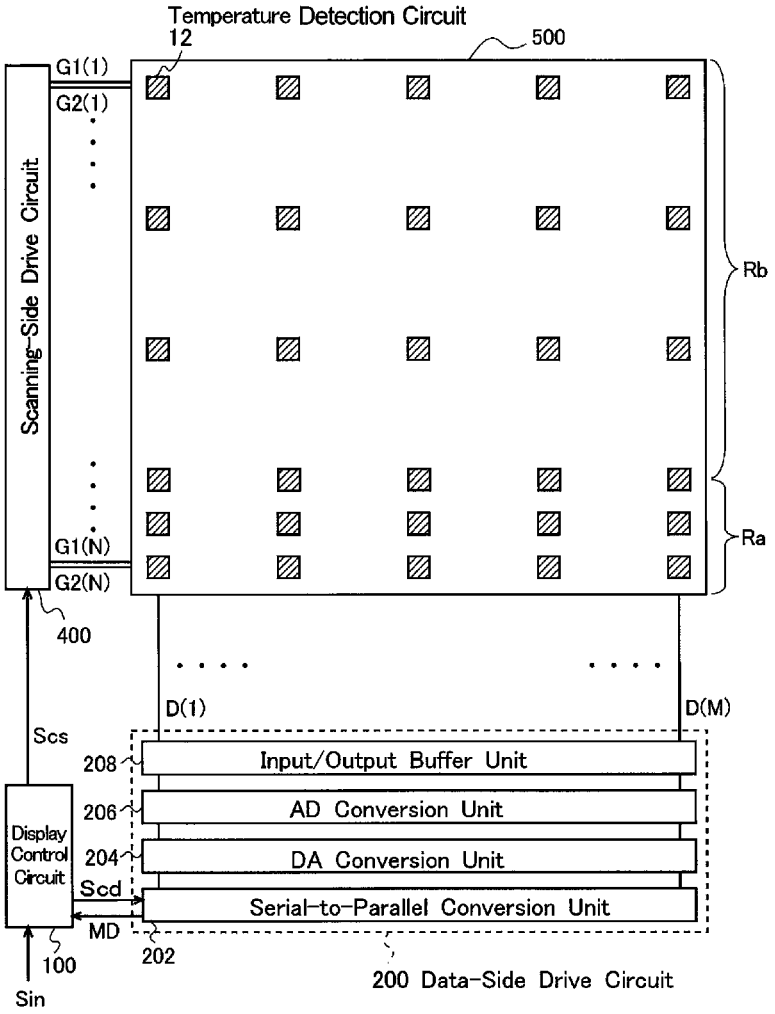
FIG. 20 is a block diagram illustrating an overall configuration of an organic EL display device according to a second embodiment.

FIG. 20 is a block diagram illustrating an overall configuration of an active matrix-type organic EL display device according to a second embodiment. Since this organic EL display device has substantially the same configuration as the organic EL display device according to the first embodiment except for the display portion 500, the same or corresponding portions are denoted by the same reference characters, and a detailed description thereof will be omitted.

Although not illustrated in FIG. 20, in the present embodiment as well, similarly to the first embodiment illustrated in FIG. 1 and the like, M (M is an integer of 2 or more) data signal lines DL(1) to DL(M), N (N is an integer of 2 or more) scanning signal lines GL1(1) to GL1(N) intersecting the data signal lines DL(1) to DL(M), and N monitoring control lines GL2(1) to GL2(N) are provided in the display portion 500. Further, in the display portion 500, a large number of pixel circuits 10 are arranged in a matrix along the M data signal lines DL(1) to DL(M) and the N scanning signal lines GL1(1) to GL1(N). Each pixel circuit 10 is connected to any one of the M data signal lines DL(1) to DL(M), is connected to any one of the N scanning signal lines GL1(1) to GL1(N), and is also connected to any one of the N monitoring control lines GL2(1) to GL2(N). However, the M data signal lines DL(1) to DL(M) include one temperature detecting data signal line to which none of the pixel circuits 10 is connected in a ratio of one to m data signal lines (q data signal lines in the entire display portion 500), and the temperature detection circuit 12 is connected to each of the q temperature detecting data signal lines DL (m), DL(2*m*), . . . , DL(q·m). In FIG. 20, the temperature detection circuit 12 is drawn as a hatched rectangle.

As illustrated in FIG. 1, in the display portion 500 in the first embodiment, one temperature detection circuit 12 for each n scanning signal lines is connected on each of the temperature detecting data signal lines DL(k·m) (k=1 to q) at equal intervals, whereas, as illustrated in FIG. 20, in the display portion 500 in the present embodiment, in a region Ra (hereinafter referred to as "display region Ra") where the distance from the data-side drive circuit 200 is equal to or less than a predetermined value, the temperature detection circuits 12 are arranged at intervals shorter than the arrangement intervals in the data signal line extending direction in a region Rb (hereinafter referred to as "display region Rb") except for the display region Ra. That is, in the example illustrated in FIG. 20, in the display portion 500, a region where the distance from the side (display portion end) to which the data-side drive circuit 200 is connected (hereinafter referred to as "the distance from the data-side drive circuit") is 30 mm or less is the display region Ra, a region where the distance from the data-side drive circuit exceeds 30 mm is the display region Rb, and the arrangement interval of the temperature detection circuit 12 in the data signal line extending direction is, for example, about 20 mm to 40 mm in the display region Rb but is, for example, about 5 mm to 10 mm in the display region Ra.

The operation of the data-side drive circuit 200 generally involves heat generation, and hence in the display portion 500, a temperature gradient (in the data signal line extending direction) is steeper in a region close to the data-side drive circuit than in a region far from the data-side drive circuit 200. Correspondingly, in the present embodiment, as described above, the arrangement interval of the temperature detection circuit 12 in the data signal line extending direction in the display region Ra where the distance from the data-side drive circuit 200 is 30 mm or less is made shorter than the arrangement interval of the temperature detection circuit 12 in the data signal line extending direction in the display region Rb where the distance from the data-side drive circuit exceeds 30 mm. Here, the distance from the data-side drive circuit of 30 mm is selected as the numerical value for specifying the display region Ra in which the arrangement interval of the temperature detection circuit 12 in the data signal line extending direction is to be shortened. This is because it is suitable for accurately performing external compensation to correct the current monitoring result on the basis of the temperature distribution obtained by the temperature detection circuit 12 disposed on the basis of the numerical value from the experience of the inventor of the present application.

According to the present embodiment as described above, as illustrated in FIG. 20, in the display region Ra of the display portion 500 where the temperature gradient is steep due to the heat generation of the data-side drive circuit 200, the temperature detection circuits 12 are arranged at shorter intervals in the data signal line extending direction than in the other display region Rb. Thus, a more accurate temperature distribution (estimated temperature in each pixel circuit 10) is obtained on the basis of the temperature detected by each temperature detection circuit 12, the current monitoring result is corrected on the basis of this temperature distribution, and external compensation (compensation for variations and deterioration in the characteristics of the drive transistors in each pixel circuit 10) using the corrected current monitoring result is performed. Therefore, the external compensation can be performed accurately as compared to the first embodiment.

3. Third Embodiment

Figure 21:
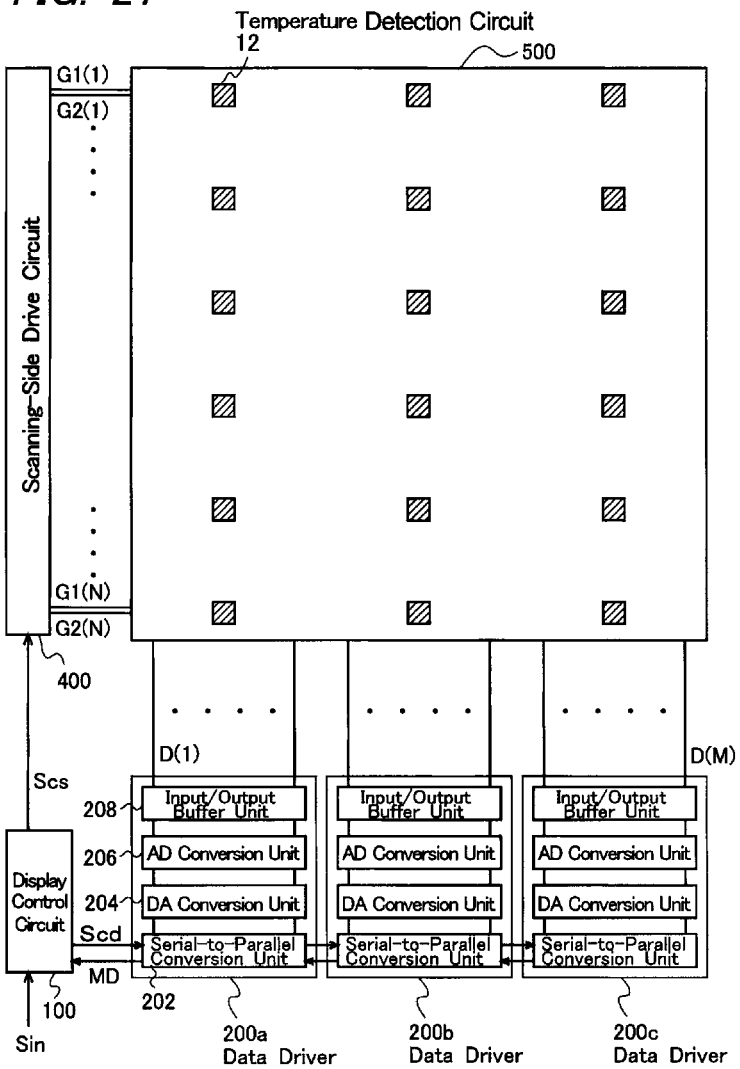
FIG. 21 is a block diagram illustrating an overall configuration of an organic EL display device according to a third embodiment.

FIG. 21 is a block diagram illustrating an overall configuration of an active matrix-type organic EL display device according to a third embodiment. Since this organic EL display device has substantially the same configuration as the organic EL display device according to the first embodiment except for the data-side drive circuit 200 and the display portion 500, the same or corresponding portions are denoted by the same reference characters, and a detailed description thereof will be omitted.

In general, when the number of pixels in the extending direction of the scanning signal line, that is, in the horizontal direction, is large in the display portion, (the data signal lines of) the display portion 500 is (are) driven using a plurality of data drivers, and normally, one data driver is implemented by one integrated circuit (IC) chip. In the present embodiment as well, (the data signal lines of) the display portion 500 is (are) driven by a plurality of data drivers. That is, the data signal lines in the display portion 500 are driven by the plurality of sub-drive circuits. More specifically, the data signal lines in the display portion 500 are grouped into a plurality of sets of data signal line groups with a predetermined number of two or more data signal lines adjacent to each other as one set, the data-side drive circuit 200 includes a plurality of data drivers as a plurality of sub-drive circuits corresponding one-to-one to the plurality of sets of data signal line groups, and each data driver is connected to a corresponding data signal line group and drives the corresponding data signal line group.

In the configuration illustrated in FIG. 21, the data-side drive circuit 200 includes three data drivers 200*a*, 200*b*, 200*c*, and the data signal lines in the display portion 500 are driven by the three data drivers 200*a*, 200*b*, 200*c*. Each data driver 200*x* (x=a, b, c) includes a serial-to-parallel conversion unit 202, a DA conversion unit 204, an AD conversion unit 206, and an input/output buffer unit 208, similarly to the data-side drive circuit 200 in the first embodiment (see FIG. 1). As illustrated in FIG. 21, the three serial-to-parallel conversion units 202, 202, 202 included in the three data drivers 200*a*, 200*b*, 200*c* are cascade-connected to each other, so that the data-side drive circuit 200 including the three data drivers 200*a*, 200*b*, 200*c* operates substantially similarly to the data-side drive circuit 200 in the first embodiment and has a similar function. Each data driver 200*x* (x=a, b, c) drives ⅓ of the number of data signal lines in the display portion 500.

Although not illustrated in FIG. 21, in the present embodiment as well, similarly to the first embodiment illustrated in FIG. 1 and the like, M (M is an integer of 2 or more) data signal lines DL(1) to DL(M), N (N is an integer of 2 or more) scanning signal lines GL1(1) to GL1(N) intersecting the data signal lines DL(1) to DL(M), and N monitoring control lines GL2(1) to GL2(N) are provided in the display portion 500. Further, in the display portion 500, a large number of pixel circuits 10 are arranged in a matrix along the M data signal lines DL(1) to DL(M) and the N scanning signal lines GL1(1) to GL1(N). Each pixel circuit 10 is connected to any one of the M data signal lines DL(1) to DL(M), is connected to any one of the N scanning signal lines GL1(1) to GL1(N), and is also connected to any one of the N monitoring control lines GL2(1) to GL2(N). However, in the M data signal lines DL(1) to DL(M), m=M/3 data signal lines include one temperature detecting data signal line (three in the entire display portion 500) to which none of the pixel circuits 10 are connected, and the temperature detection circuits 12 are connected to each of the three temperature detecting data signal lines. In FIG. 21, the temperature detection circuits 12 are each drawn as a hatched rectangle.

In the data-side drive circuit 200 in the present embodiment, the first data driver 200*a* drives the data signal lines DL(1) to DL(m), the second data driver 200*b* drives the data signal lines DL(m+1) to DL(2*m*), and the third data driver 200*a* drives the data signal lines DL(2*m*+1) to DL(3*m*) (m=an integer of M/3). One data signal line near the center among the data signal lines DL((k−1) m+1) to DL(k·m) (k=1, 2, and 3) driven by each data driver 200*x* (x=a, b, c) is a temperature detecting data signal line to which the pixel circuit 10 is not connected but only the temperature detection circuit 12 is connected. The temperature detecting data signal line in each data driver 200*x* is preferably any one of (m/3)th to (2 m/3)th data signal lines among the m data signal lines connected to the data driver 200*x*.

According to the present embodiment as described above, each data driver 200*x* (x=a, b, c) is in charge of a region of the display portion 500, in which the m data signal lines driven by the data driver 200*x* are arranged, and obtains a temperature distribution in the region in charge on the basis of a temperature detected by the temperature detection circuit 12 in the region in charge (specifically obtains an estimated temperature of each pixel circuit 10 in the region in charge). Thus, for each data driver 200*x*, the current monitoring result is corrected on the basis of the estimated temperature of each pixel circuit in the region in charge, and external compensation (compensation for variations and deterioration in the characteristics of the drive transistor in each pixel circuit 10) using the corrected current monitoring result is performed. In this manner, the temperature distribution of the region in charge can be obtained for each data driver 200*x*, and external compensation can be performed appropriately.

According to the present embodiment, only one column of temperature detection circuits 12 (a predetermined number of temperature detection circuits 12 connected to one temperature detecting data signal line) is provided for one data driver 200*x*. Thus, as compared to a case where a plurality of columns of temperature detection circuits 12 are provided for one data driver 200*x*, a circuit that processes temperature information including the temperature obtained by the temperature detection circuit 12 can be simplified or reduced. However, two or more columns of temperature detection circuits 12 may be provided in one data driver 200*x*. That is, two or more temperature detecting data signal lines may be connected to one data driver 200*x*, and even in such a case, the external compensation can be appropriately performed by obtaining the temperature distribution of the region in charge for each data driver 200*x*.

4. Fourth Embodiment

Figure 22:
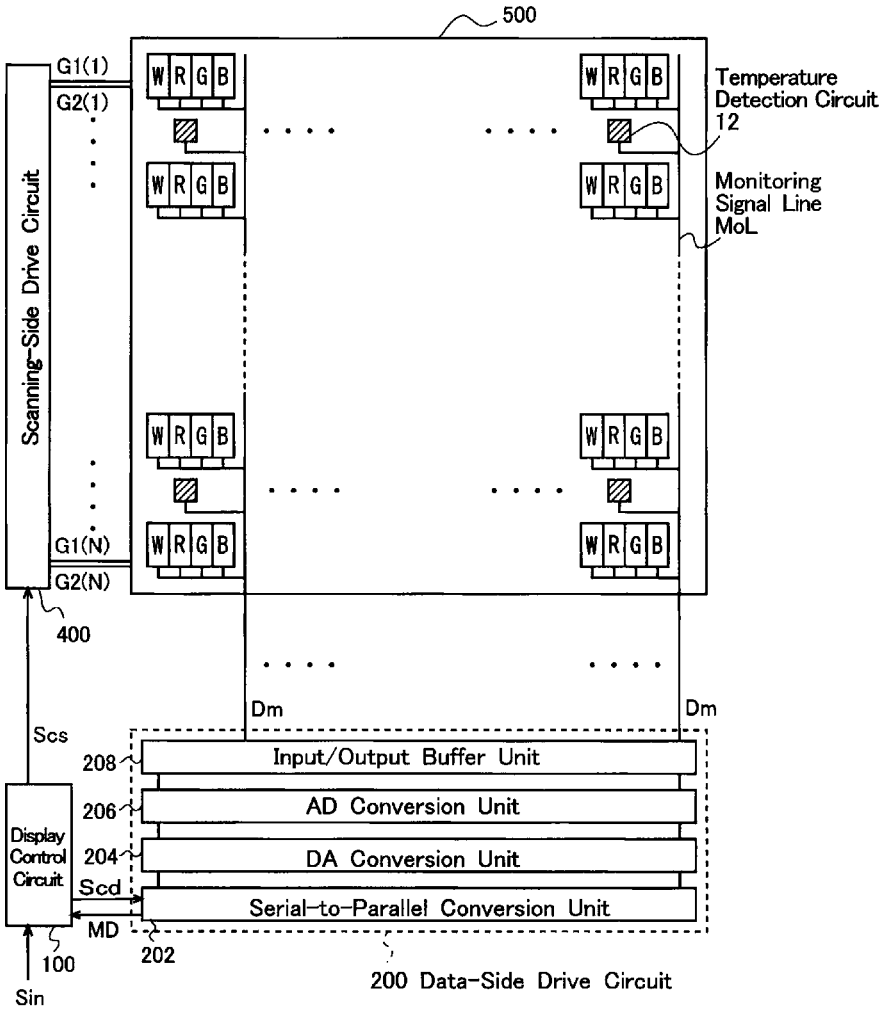
FIG. 22 is a block diagram illustrating an overall configuration of an organic EL display device according to a fourth embodiment.

FIG. 22 is a block diagram illustrating an overall configuration of an active matrix-type organic EL display device according to a fourth embodiment. Since this organic EL display device has substantially the same configuration as the organic EL display device according to the first embodiment except for the data-side drive circuit 200 and the display portion 500, the same or corresponding portions are denoted by the same reference characters, and a detailed description thereof will be omitted.

Although not illustrated in FIG. 22, in the present embodiment, the display portion 500 is provided with M sets (M is an integer of 2 or more) of data signal lines DLw(1), DLr(1), DLg(1), DLb(1) to DLw(M), DLr(M), DLg(M), DLb(M), in which one set includes four data signal lines including a white data signal line DLw(j), a red data signal line DLr(i), a green data signal line DLg(i), and a blue data signal line DLb(i), and is provided with N (N is an integer of 2 or more) scanning signal lines GL1(1) to GL1(N) and N monitoring control lines GL2(1) to GL2(N) intersecting the scanning signal lines. In addition, one monitoring signal line MoL is provided along the data signal line for each one set of data signal lines including the white data signal line DLw(j), the red data signal line DLr(i), the green data signal line DLg(i), and the blue data signal line DLb(i). In the display portion 500, a large number of pixel circuits 10 are arranged in a matrix along 4M data signal lines DLw(i), DLr(i), DLg(i), DLb(i) (i=1 to M) and the N scanning signal lines GL1(1) to GL1(N).

Figure 23:
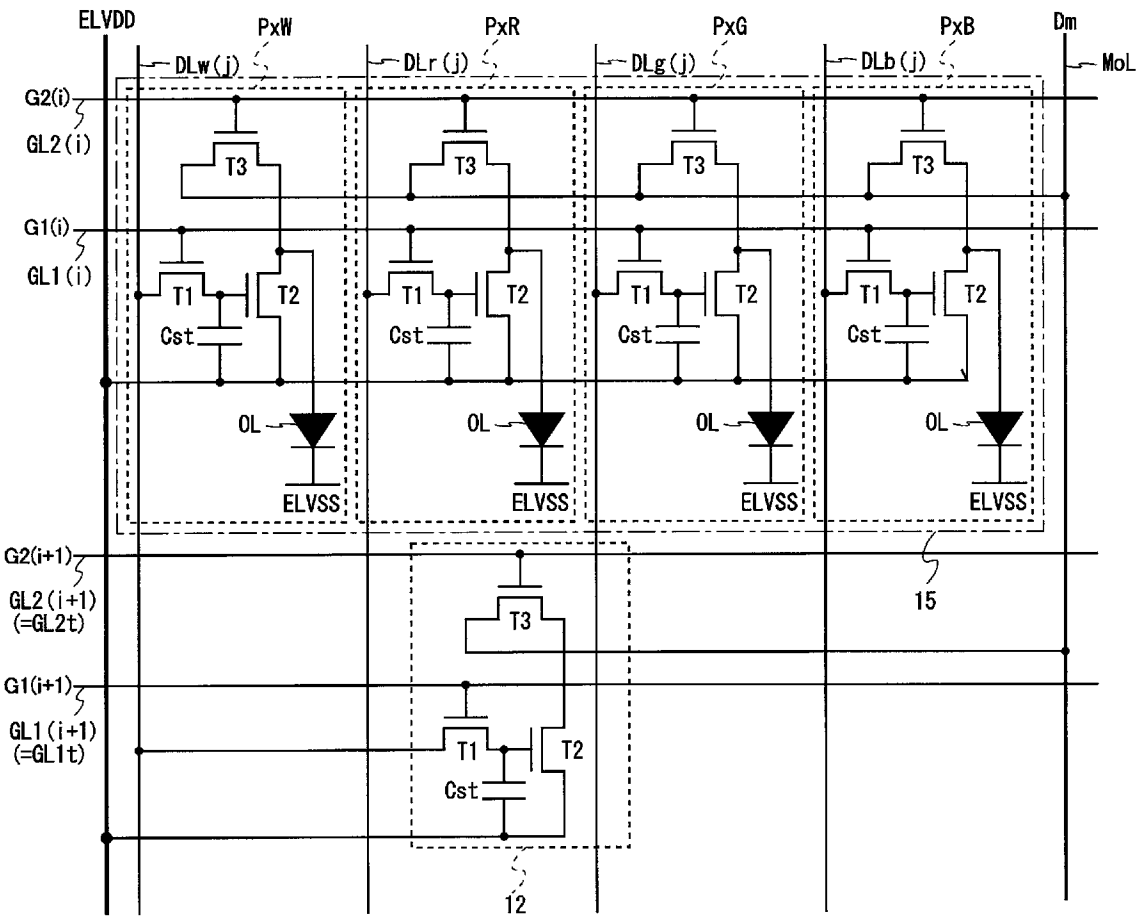
FIG. 23 is a circuit diagram illustrating electrical configurations of a pixel circuit and a temperature detection circuit in the fourth embodiment.

FIG. 23 is a circuit diagram illustrating electrical configurations of pixel circuits PxW, PxR, PxG, PxB and the temperature detection circuit 12 in the present embodiment. The display portion 500 is configured to display a color image, and a pixel formation portion 15 for forming each pixel in a color image to be displayed is provided in the display portion 500. Each pixel formation portion 15 is made up of four pixel circuits including a white pixel circuit PxW, a red pixel circuit PxR, a green pixel circuit PxG, and a blue pixel circuit PxB adjacent in the extending direction of the scanning signal line. The white pixel circuit PxW, the red pixel circuit PxR, the green pixel circuit PxG, and the blue pixel circuit PxB emit white light, red light, green light, and blue light, respectively, at the time of lighting. Each white pixel circuit PxW is connected to any one of the M white data signal lines DLw(1) to DLw(M), each red pixel circuit PxR is connected to any one of the M red data signal lines DLr(1) to DLr(M), each green pixel circuit PxG is connected to any one of the M green data signal lines DLg(1) to DLg(M), and each blue pixel circuit PxB is connected to any one of the M blue data signal lines DLb(1) to DLb(M). The four pixel circuits PxW, PxR, PxG, PxB corresponding to the respective pixels for color image display and adjacent to each other are connected to any one of the M monitoring signal lines MoL in the display portion 500. Further, each pixel circuit PxX (X=W, R, G, B) is also connected to any one of the scanning signal lines GL1(1) to GL1(N) and any one of the monitoring control lines GL2(1) to GL2(N).

As illustrated in FIGS. 22 and 23, in the display portion 500, one temperature detection circuit 12 is provided for the four pixel circuits PxW, PxR, PxG, PxB constituting one pixel formation portion 15 in the extending direction of the scanning signal line. Further, in the display portion 500, the temperature detection scanning signal line GL1*t*=GL1(*it*) is provided for one scanning signal line or more in a predetermined number, and the pixel circuit is not connected to each temperature detection scanning signal line GL1*t*, but only the temperature detection circuit 12 is connected to each temperature detection scanning signal line GL1*t*. Then, the four pixel circuits PxW, PxR, PxG, PxB constituting each pixel formation portion 15 are connected to any one of the M monitoring signal lines MoL, and when one temperature detection circuit 12 is provided for each of the four pixel circuits PxW, PxR, PxG, PxB, the temperature detection circuit 12 is also connected to the monitoring signal line MoL. Among the four data signal lines DLw(j), DLr(j), DLg(j), DLb(j) respectively connected to the four pixel circuits PxW, PxR, PxG, PxB, the white data signal line DLw is also connected to the corresponding temperature detection circuit 12.

Note that, as illustrated in FIG. 23, each pixel circuit PxX (X=W, R, G, B) in the present embodiment has an electrical configuration similar to that of the pixel circuit 10 in the first embodiment (see FIG. 3) and includes transistors T1, T2, T3, a capacitor Cst, and an organic EL element OL. As illustrated in FIG. 23, the temperature detection circuit 12 according to the present embodiment also has an electrical configuration similar to that of the temperature detection circuit 12 according to the first embodiment (see FIG. 4) and includes transistors T1, T2, T3 and a capacitor Cst.

Figure 24:
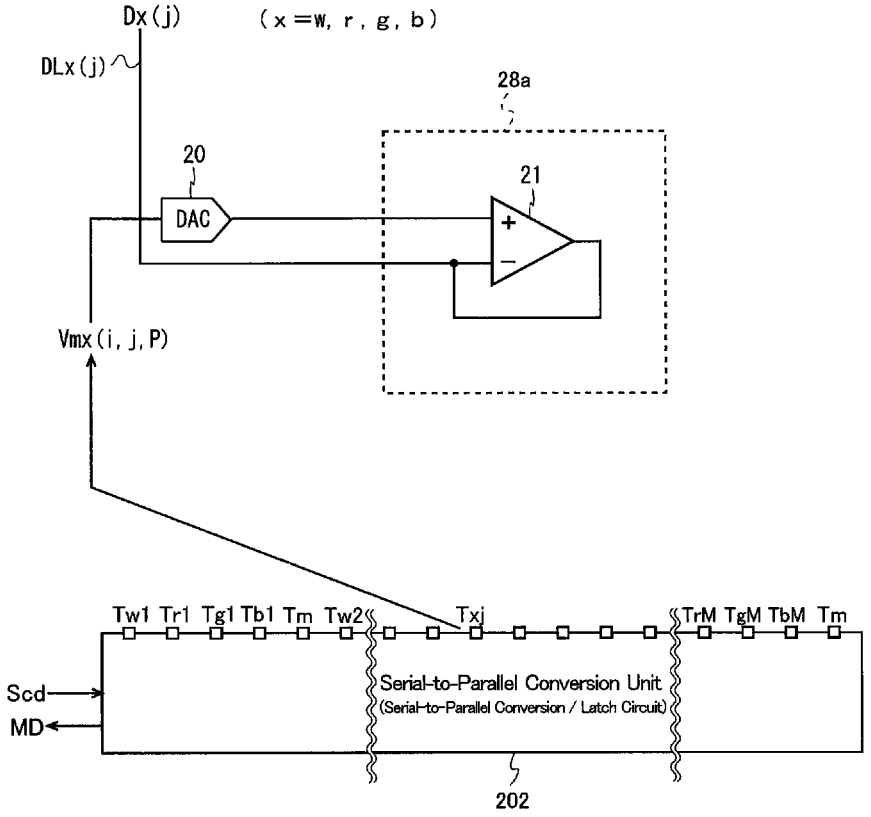
FIG. 24 is a circuit diagram for describing a detailed configuration of a portion to which a data signal line is connected in a data-side drive circuit in the fourth embodiment.
Figure 25:
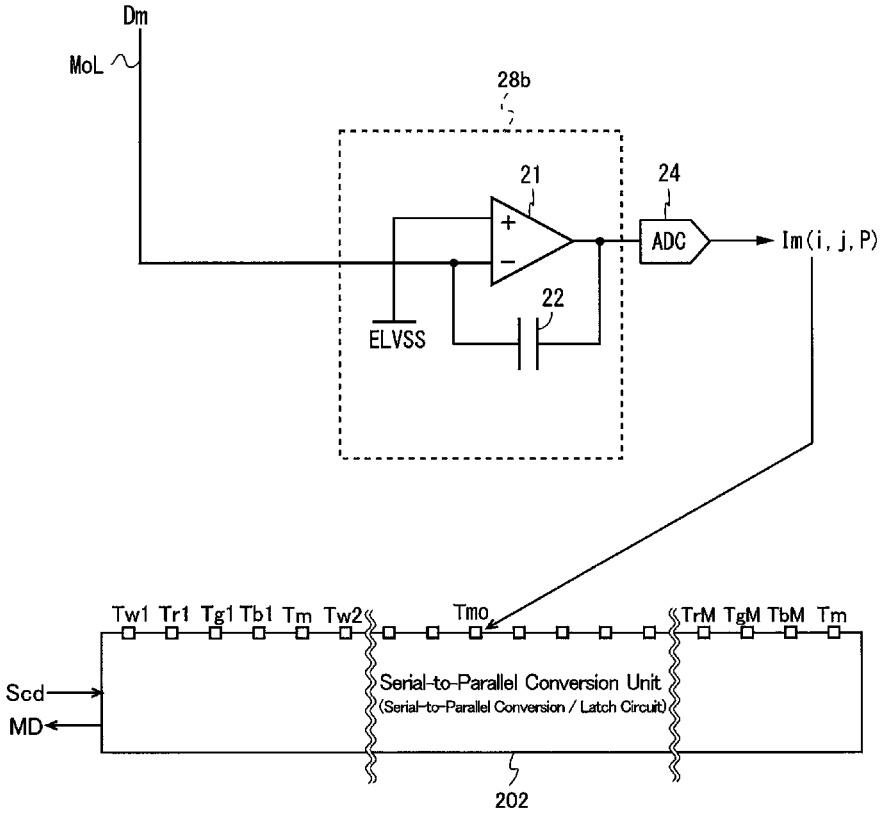
FIG. 25 is a circuit diagram for describing a detailed configuration of a portion to which a monitoring signal line is connected in the data-side drive circuit in the fourth embodiment.

As illustrated in FIG. 22, the data-side drive circuit 200 according to the present embodiment includes a serial-to-parallel conversion unit 202, a DA conversion unit 204, an AD conversion unit 206, and an input/output buffer unit 208 as in the first embodiment (see FIG. 1). However, the data-side drive circuit 200 according to the present embodiment is connected with the M sets of data signal lines DLw(1), DLr(1), DLg(1), DLb(1) to DLw(M), DLr(M), DLg(M), DLb(M), each including four data signal lines consisting of the white data signal line DLw(j), the red data signal line DLr(i), the green data signal line DLg(i), and the blue data signal line DLb(i) as one set, and is also connected with the M monitoring signal lines MoL provided one by one for one set of data signal lines DLw(j), DLr(j), DLg(j), DLb(j) as illustrated in FIG. 22. Hence, a specific configuration of the data-side drive circuit 200 is different from that of the first embodiment. Hereinafter, this point will be described in detail with reference to FIGS. 24 and 25. FIG. 24 is a circuit diagram for describing a detailed configuration of a portion of the data-side drive circuit 200 in the present embodiment to which one data signal line DLx(j) (x is any of w, r, g, and b) is connected. FIG. 25 is a circuit diagram for describing a detailed configuration of a portion of the data-side drive circuit 200 in the present embodiment to which one monitoring signal line MoL is connected.

M data signal lines DL(1) to DL(M) are connected to the data-side drive circuit 200 in the first embodiment, and each data signal line DL(j) also functions as a monitoring signal line for measuring a current in the pixel circuit Pix(i, j) in the characteristic detection mode. Therefore, a portion of the data-side drive circuit 200 to which one data signal line DL(j) is connected is configured as illustrated in FIG. 6.

In contrast, in the present embodiment, a portion of the data-side drive circuit 200 to which one data signal line DLx(j) (x is any of w, r, g, and b) is connected is configured as illustrated in FIG. 24. That is, the data-side drive circuit 200 includes an output buffer 28*a* and a DA converter (DAC) 20 as circuit portions corresponding to one data signal line DLx(j). The DA conversion unit 20 sequentially receives the digital image signal Vmx (i, j, P) (i=1 to N) corresponding to one sub-pixel output from the jth X-color signal output terminal Txj (X is any of W, R, G, and B, and x is any of w, r, g, and b corresponding thereto) among the digital image signals for one row from the serial-to-parallel conversion unit 202. Here, the digital image signal Vmx (i, j, P) is a digital signal indicating a data voltage to be applied to the X-color pixel circuit PxX in the ith row and the jth set in order to display a pixel with a gradation value P in the pixel circuit PxX. The output buffer 28*a* is a voltage follower configured using the operational amplifier 21, and the operational amplifier 21 has an output terminal connected to an inversion input terminal and the data signal line DLx(j) and has a non-inversion input terminal connected to the output terminal of the DA conversion unit 20. The input terminal of the DA conversion unit 20 is connected to a corresponding terminal in the serial-to-parallel conversion unit 202, that is, the jth X-color signal output terminal Txj. With such a configuration, the digital signal Vm(i, j, P) input to the DA conversion unit 20 is converted into an analog voltage signal and provided to the data signal line DLx(j) with low output impedance.

In the present embodiment, a portion of the data-side drive circuit 200 to which one monitoring signal line MoL is connected is configured as illustrated in FIG. 25. That is, the data-side drive circuit 200 includes an input buffer 28*b* and the AD conversion unit 24 as circuit portions corresponding to one monitoring signal line MoL. The input buffer 28*b* includes an operational amplifier 21 and a capacitor 22. The operational amplifier 21 has an inversion input terminal connected to the monitoring signal line MoL, has a non-inversion input terminal connected to the low-level power supply line ELVSS, and has an output terminal connected to an inversion input terminal via a capacitor 22. With such a configuration, in the characteristic detection mode, the current output from the X-color pixel circuit PxX in the pixel formation portion 15 in the jth column connected to the monitoring control line GL2(*i*) in the selected state or the temperature detection circuit 12 connected to the monitoring control line GL2(*i*) and corresponding to the pixel formation portion 15 in the jth column (the current flowing through the transistor T2 of the pixel circuit PxX or the temperature detection circuit 12) is provided to the input buffer 28*b* via the monitoring signal line MoL. The input buffer 28*b* generates a voltage signal indicating the current, and the voltage signal is converted into a digital signal Im(i, j, P) by the AD conversion unit 24 and provided to the corresponding input terminal Tmo in the serial-to-parallel conversion unit 202.

In the present embodiment, as illustrated in FIGS. 22 and 23, one monitoring signal line MoL is shared by four pixel circuits PxW, PxR, PxG, PxB constituting one pixel formation portion 15, and the same monitoring control line GL2(*i*) is connected to the four pixel circuits PxW, PxR, PxG, PxB. In such a configuration, for measuring the current for each pixel circuit PxX so as to perform the external compensation for each pixel circuit PxX (X is any of W, R, G, and B), for example, the data signal line DLx(j) (x=w, r, g, b; j=1 to M) and the scanning signal line GL1(*i*) (i=1 to N) may be driven as follows in conjunction with the driving of the monitoring control line GL2(*i*) (i=1 to N). That is, in the characteristic detection mode, the data signal line DLx(j) (x=w, r, g, b; j=1 to M) and the scanning signal line GL1(*i*) (i=1 to N) may be driven such that the data voltage corresponding to the first gradation value P1 or the second gradation value P2 is written only to any one of the four pixel circuits PxW, PxR, PxG, PxB constituting each pixel formation portion 15, data voltage corresponding to a black voltage (a voltage at which a drive current does not flow) is written to each of the other pixel circuits, and the pixel circuit to which the data voltage corresponding to the first gradation value P1 or the second gradation value P2 is written sequentially switches among the four pixel circuits PxW, PxR, PxG, PxB. Further, since the four pixel circuits PxW, PxR, PxG, PxB constituting one pixel formation portion 15 are close to each other, another example of the drive method in the characteristic detection mode as follows is also conceivable. That is, the characteristics (threshold voltage and gain) of the drive transistors T2 in the four pixel circuits PxW, PxR, PxG, PxB may be regarded as the same, the data signal line DLx(j) (x=w, r, g, b; j=1 to M) and the scanning signal line GL1(*i*) (i=1 to N) may be driven so as to simultaneously write the data voltage corresponding to the first gradation value P1 or the second gradation value P2 to each of the four pixel circuits PxW, PxR, PxG, PxB, and the current corresponding to the sum of the currents flowing through (the drive transistors T2 of) the four pixel circuits PxW, PxR, PxG, PxB may be measured via the monitoring signal line MoL. In this case, the same correction data (threshold voltage correction data and gain correction data) is used for each of the four pixel circuits PxW, PxR, PxG, PxB, and external compensation is performed for each of the four pixel circuits PxW, PxR, PxG, PxB (for each pixel formation portion 15).

According to the present embodiment as described above, also, in the organic EL display device in which one pixel in the color image is formed of a plurality of pixel circuits (the four pixel circuits PxW, PxR, PxG, PxB in the configuration of FIG. 22), the temperature distribution (specifically, the estimated temperature in each of the pixel circuits PxW, PxR, PxG, PxB) of the display portion 500 is obtained on the basis of the temperature detected by the temperature detection circuit 12, and the current monitoring result for each of the pixel circuits PxW, PxR, PxG, PxB is corrected on the basis of the estimated temperature of the pixel circuit. External compensation (compensation for variations and deterioration in the characteristics of the drive transistor in each of the pixel circuits PxW, PxR, PxG, PxB) is performed using the corrected current monitoring result, that is, the temperature-compensated current monitoring result. Thus, according to the present embodiment, the same effects as those of the first embodiment can be obtained also in an organic EL display device in which one pixel in a color image is formed of a plurality of pixel circuits.

Further, according to the present embodiment, by providing one temperature detection circuit 12 for a plurality of pixel circuits (the four pixel circuits PxW, PxR, PxG, PxB in the configuration of FIG. 22) corresponding to one pixel in a color image, it is possible to simplify a configuration of a circuit necessary for temperature detection and correction of a current monitoring result based on the temperature detection and to reduce a circuit amount. Further, in the present embodiment, since the monitoring signal line MoL is provided separately from the data signal line, and one monitoring signal line MoL is shared by the plurality of pixel circuits and the one temperature detection circuit 12, the configuration is simplified in the data-side drive circuit 200, and the necessary circuit amount is also reduced (see FIGS. 23 to 25).

In the present embodiment, in order to display a color image on the basis of four primary colors of white, red, green, and blue, one pixel in the color image is formed of the four pixel circuits PxW, PxR, PxG, PxB corresponding to the four primary colors, but in order to display a color image on the basis of three primary colors including primary colors except for the four primary colors, for example, red, green, and blue, one pixel in the color image may be formed of the three pixel circuits PxR, PxG, PxB corresponding to the three primary colors. Further, regardless of the number of primary colors for color image display, one temperature detection circuit 12 may be provided for each two or more adjacent pixel circuits 10, which are adjacent in the extending direction (horizontal direction) of the scanning signal line, and the monitoring signal line may be provided accordingly in the same manner as described above.

5. Modifications

The disclosure is not limited to each of the above embodiments, and various modifications can be made so long as not deviating from the scope of the disclosure.

For example, in each of the above embodiments, the pixel circuit 10 is configured as illustrated in FIG. 3, and the pixel circuits PxW, PxR, PxG, PxB are configured as illustrated in FIG. 23, but the configurations of the pixel circuit 10 and the pixel circuits PxW, PxR, PxG, PxB are not limited to the configurations illustrated in these drawings. These pixel circuits may each be a pixel circuit including a display element driven by a current, a holding capacitor that holds a data voltage for controlling the drive current of the display element, and a drive transistor that controls the drive current of the display element in accordance with the data voltage held in the holding capacitor and may be configured to cause the current flowing through the drive transistor to be taken out from the display portion 500. Further, the configuration of the temperature detection circuit 12 is not limited to the configuration illustrated in FIG. 4 or FIG. 23 but may have the same configuration as the pixel circuit except that a display element such as an organic EL element driven by a current is not included.

In each of the above embodiments, the threshold voltage and the gain have been taken up as the transistor characteristics the variations and deterioration of which are to be compensated for, but the variations and the like of the transistor characteristics including one of these or other characteristic parameters in addition to these may be compensated for.

The operation in each of the above-described embodiments is not limited to the operation examples illustrated in FIGS. 7, 8, 12, 18, and 19 but may be any operation in which processing is performed to obtain an estimated temperature of each pixel circuit on the premise of the configuration illustrated in FIG. 1, 20, 21, or 22, perform temperature compensation on the current monitoring result of each pixel circuit on the basis of the estimated temperature, and compensate for variations and deterioration in the characteristics of the drive transistors in each pixel circuit on the basis of the temperature-compensated current monitoring result. In the operation examples illustrated in (A) to (C) of FIG. 7, when the power switch of the display device is turned off, the operation mode is switched from the normal display mode to the characteristic detection mode, but as described above, the operation mode may be switched by another means.

Further, in the above, the embodiments and the modifications thereof have been described by taking the organic EL display device as an example, but the disclosure is not limited to the organic EL display device and may be applied to any display device using a display element that is driven by a current. The display element that can be used here is a display element with its luminance, transmittance, and the like, controlled by a current, and for example, an inorganic light-emitting diode, a quantum dot light-emitting diode (QLED), and the like can be used in addition to the organic EL element, that is, the organic light-emitting diode (OLED)).

DESCRIPTION OF REFERENCE CHARACTERS

10: PIXEL CIRCUIT
12: TEMPERATURE DETECTION CIRCUIT
20: DA CONVERTER
24: AD CONVERTER
28: INPUT/OUTPUT BUFFER
100: DISPLAY CONTROL CIRCUIT
101: FIRST LUT
105: SECOND LUT
106: CPU

108: THIRD LUT
109: FOURTH LUT
110: DATA-SIDE CONTROL SIGNAL GENERATION CIRCUIT
120: SCANNING-SIDE CONTROL SIGNAL GENERATION CIRCUIT
140: RAM
141: GAIN CORRECTION MEMORY
142: THRESHOLD VOLTAGE CORRECTION MEMORY
150: FLASH MEMORY
200: DATA-SIDE DRIVE CIRCUIT (DATA SIGNAL LINE DRIVE CIRCUIT)
202: SERIAL-TO-PARALLEL CONVERSION UNIT
204: DA CONVERSION UNIT
206: AD CONVERSION UNIT
208: INPUT/OUTPUT BUFFER UNIT
400: SCANNING-SIDE DRIVE CIRCUIT (SCANNING SIGNAL LINE DRIVE CIRCUIT AND MONITORING CONTROL LINE DRIVE CIRCUIT)
500: DISPLAY PORTION
T1: INPUT TRANSISTOR (INPUT SWITCHING ELEMENT)
T2: DRIVE TRANSISTOR, TEMPERATURE DETECTING TRANSISTOR
T3: MONITORING CONTROL TRANSISTOR (MONITORING CONTROL SWITCHING ELEMENT)
Cst: CAPACITOR (HOLDING CAPACITOR)
OL: ORGANIC EL ELEMENT (DISPLAY ELEMENT)
GL1 (*i*): SCANNING SIGNAL LINE (j=1 to N)
GL2 (*i*): MONITORING CONTROL LINE (j=1 to N)
DL (j): DATA SIGNAL LINE (j=1 to M)
MoL: MONITORING SIGNAL LINE
Pix (ip, jp): PIXEL CIRCUIT
Tmp (it, jt): TEMPERATURE DETECTION CIRCUIT
ELVDD: HIGH-LEVEL POWER SUPPLY LINE (FIRST POWER SUPPLY LINE)
ELVSS: LOW-LEVEL POWER SUPPLY LINE (SECOND POWER SUPPLY LINE)

The invention claimed is:

1. A display device comprising:

a display portion including a plurality of data signal lines, a plurality of scanning signal lines intersecting the plurality of data signal lines, and a plurality of pixel circuits arranged along the plurality of data signal lines and the plurality of scanning signal lines;

a data signal line drive circuit configured to drive the plurality of data signal lines;

a scanning signal line drive circuit configured to selectively drive the plurality of scanning signal lines;

an external compensation circuit configured to measure a current flowing through each of the plurality of pixel circuits and to compensate for a variation in a characteristic of each of the plurality of pixel circuits;

two or more temperature detection circuits arranged such that the two or more temperature detection circuits respectively correspond to two or more intersections among intersections of the plurality of data signal lines and the plurality of scanning signal lines;

a temperature measurement circuit configured to measure a temperature of each of the two or more temperature detection circuits;

a plurality of monitoring control lines provided along the plurality of scanning signal lines such that the plurality of monitoring control lines respectively corresponds to the plurality of scanning signal lines;

a monitoring control line drive circuit configured to drive the plurality of monitoring control lines; and first and second power supply lines, wherein each of the plurality of pixel circuits includes a display element driven by a current, a holding capacitor, a drive transistor that controls a drive current of the display element in accordance with a voltage held in the holding capacitor, and a switching element for monitoring, and is configured such that a voltage of a corresponding one of the plurality of data signal lines is written to the holding capacitor when a corresponding one of the plurality of scanning signal lines is selected, in each of the plurality of pixel circuits, the drive transistor has a first conductive terminal connected to the first power supply line, the drive transistor has a second conductive terminal that is connected to the second power supply line via the display element, and that is connected to a data signal line in the plurality of data signal lines corresponding to the pixel circuit via the switching element for monitoring, and the switching element for monitoring has a control terminal connected to one of the plurality of monitoring control lines corresponding to the pixel circuit, each of the two or more temperature detection circuits includes a temperature detecting transistor and a switching element for monitoring, in each of the two or more temperature detection circuits, the temperature detecting transistor has a first conductive terminal connected to the first power supply line, the temperature detecting transistor has a second conductive terminal connected to the corresponding one of the plurality of data signal lines via the switching element for monitoring, and the switching element for monitoring has a control terminal connected to one of the plurality of monitoring control lines corresponding to a scanning signal line in the plurality of scanning signal lines that passes through an intersection corresponding to the temperature detection circuit, the temperature measurement circuit measures a current flowing through the temperature detecting transistor in each of the two or more temperature detection circuits via the switching element for monitoring and the corresponding one of the plurality of data signal lines to obtain the temperature of each of the two or more temperature detection circuits, and the external compensation circuit estimates a temperature distribution in the display portion based on the temperature of each of the two or more temperature detection circuits obtained by the temperature measurement circuit, corrects a measurement result of a current in each of the plurality of pixel circuits based on the estimated temperature distribution, and compensates for a variation in a characteristic of each of the plurality of pixel circuits based on the corrected measurement result.

2. The display device according to claim 1, wherein the external compensation circuit further estimates the temperature distribution in the display portion based on the temperature obtained by the temperature measurement circuit, corrects a measurement result of a current in each of the plurality of pixel circuits based on the estimated temperature distribution, and performs correction for compensating for flail the variation in a characteristic of each of the plurality of pixel circuits on image data externally received and representing an image to be displayed based on the corrected measurement result.

3. The display device according to claim 1, wherein an interval at which the two or more temperature detection circuits are arranged in an extending direction of the plurality of data signal lines is narrower in a first region close to a display portion end on a side where the data signal line drive circuit is arranged than in a second region far from the display portion end.

4. The display device according to claim 3, wherein the first region is 30 mm or less from the display portion end and the second region is more than 30 mm away from the display portion end.

5. The display device according to claim 1, wherein the data signal line drive circuit includes a plurality of sub-drive circuits corresponding one-to-one to a plurality of sets of data signal line groups obtained by grouping the plurality of data signal lines as a set of two or more data signal lines adjacent to each other, and each of the sub-drive circuits drives a corresponding one of the plurality of sets of data signal line groups, and a plurality of temperature detection circuits among the two or more temperature detection circuits is connected to at least one data signal line in one of the plurality of sets of data signal line groups corresponding to each of the sub-drive circuits.

6. The display device according to claim 5, wherein the plurality of temperature detection circuits is connected to at least one data signal line located at a substantially center in the one of the plurality of sets of data signal line groups corresponding to each of the sub-drive circuits.

7. The display device according to claim 6, wherein in the one of the plurality of sets of data signal line groups corresponding to each of the sub-drive circuits, the plurality of temperature detection circuits is connected to at least one data signal line between a position corresponding to ⅓ of a number of data signal lines in the one of the plurality of sets and a position corresponding to ⅔ of the number of data signal lines in the one of the plurality of sets from a data signal line located at one end.

8. The display device according to claim 1, wherein each of the two or more temperature detection circuits includes a capacitor, and is configured such that a voltage of a corresponding one of the plurality of data signal lines is written to the capacitor when a corresponding one of the plurality of scanning signal lines is selected, and a current flows through the temperature detecting transistor in accordance with a voltage held in the capacitor.

9. A display device comprising:

a display portion including a plurality of data signal lines, a plurality of scanning signal lines intersecting the plurality of data signal lines, and a plurality of pixel circuits arranged along the plurality of data signal lines and the plurality of scanning signal lines;

a data signal line drive circuit configured to drive the plurality of data signal lines;

a scanning signal line drive circuit configured to selectively drive the plurality of scanning signal lines;

an external compensation circuit configured to measure a current flowing through each of the plurality of pixel circuits and to compensate for a variation in a characteristic of each of the plurality of pixel circuits;

two or more temperature detection circuits arranged such that the two or more temperature detection circuits respectively correspond to two or more intersections among intersections of the plurality of data signal lines and the plurality of scanning signal lines;

a temperature measurement circuit configured to measure a temperature of each of the two or more temperature detection circuits; and a plurality of monitoring signal lines provided one by one along the plurality of data signal lines for every two or more adjacent data signal lines, wherein each of the plurality of pixel circuits includes a display element driven by a current, a holding capacitor, and a drive transistor that controls a drive current of the display element in accordance with a voltage held in the holding capacitor, and is configured such that a voltage of a corresponding one of the plurality of data signal lines is written to the holding capacitor when a corresponding one of the plurality of scanning signal lines is selected, each of the two or more temperature detection circuits includes a temperature detecting transistor, two or more of the plurality of pixel circuits respectively connected to the two or more adjacent data signal lines and adjacent in an extending direction of the plurality of scanning signal lines are connected to one of the monitoring signal lines corresponding to the two or more adjacent data signal lines, a plurality of temperature detection circuits among the two or more temperature detection circuits is connected to each of the monitoring signal lines, and each of the two or more temperature detection circuits is connected to any one of the monitoring signal lines, the temperature measurement circuit measures a current flowing through the temperature detecting transistor in each of the two or more temperature detection circuits via the any one of the monitoring signal lines to obtain the temperature of each of the two or more temperature detection circuits, and the external compensation circuit estimates a temperature distribution in the display portion based on the temperature of each of the two or more temperature detection circuits obtained by the temperature measurement circuit, corrects a measurement result of a current in each of the plurality of pixel circuits based on the estimated temperature distribution, and compensates for a variation in a characteristic of each of the plurality of pixel circuits based on the corrected measurement result.

10. The display device according to claim 9, wherein the display portion is configured to display a color image, the two or more of the plurality of pixel circuits correspond one-to-one to a predetermined number of primary colors for displaying the color image, and each of the two or more of the plurality of pixel circuits is configured to emit light of a corresponding one of the predetermined number of primary colors.

11. The display device according to claim 9, further comprising:

a plurality of monitoring control lines provided along the plurality of scanning signal lines such that the plurality of monitoring control lines respectively corresponds to the plurality of scanning signal lines;

a monitoring control line drive circuit configured to drive the plurality of monitoring control lines; and first and second power supply lines, wherein each of the plurality of pixel circuits further includes a switching element for monitoring, in each of the two or more adjacent pixel circuits, the drive transistor has a first conductive terminal connected to the first power supply line, the drive transistor has a second conductive terminal that is connected to the second power supply line via the display element, and that is connected to the corresponding one of the monitoring signal lines via the switching element for monitoring, and the switching element for monitoring has a control terminal connected to one of the plurality of monitoring control lines corresponding to each of the two or more adjacent pixel circuits, each of the two or more temperature detection circuits further includes a switching element for monitoring, in each of the two or more temperature detection circuits, the temperature detecting transistor has a first conductive terminal connected to the first power supply line, the temperature detecting transistor has a second conductive terminal connected to the any one of the plurality of monitoring signal lines via the switching element for monitoring, and the switching element for monitoring has a control terminal connected to one of the plurality of monitoring control lines corresponding to a scanning signal line in the plurality of scanning signal lines that passes through an intersection corresponding to the temperature detection circuit, and the temperature measurement circuit measures a current flowing through the temperature detecting transistor in each of the two or more temperature detection circuits via the switching element for monitoring and the any one of the monitoring signal lines to obtain the temperature of each of the two or more temperature detection circuits.

12. The display device according to claim 1, wherein the variation in the characteristic of each of the pixel circuits compensated by the external compensation circuit includes a variation in a threshold voltage of the drive transistor.

13. A display device comprising:

a display portion including a plurality of data signal lines, a plurality of scanning signal lines intersecting the plurality of data signal lines, and a plurality of pixel circuits arranged along the plurality of data signal lines and the plurality of scanning signal lines;

a data signal line drive circuit configured to drive the plurality of data signal lines;

a scanning signal line drive circuit configured to selectively drive the plurality of scanning signal lines;

an external compensation circuit configured to measure a current flowing through each of the plurality of pixel circuits and to compensate for a variation in a characteristic of each of the plurality of pixel circuits;

two or more temperature detection circuits arranged such that the two or more temperature detection circuits respectively correspond to two or more intersections among intersections of the plurality of data signal lines and the plurality of scanning signal lines; and a temperature measurement circuit configured to measure a temperature of each of the two or more temperature detection circuits, wherein each of the plurality of pixel circuits includes a display element driven by a current, a holding capacitor, and a drive transistor that controls a drive current of the display element in accordance with a voltage held in the holding capacitor, and is configured such that a voltage of a corresponding one of the plurality of data signal lines is written to the holding capacitor when a corresponding one of the plurality of scanning signal lines is selected, each of the temperature detection circuits includes a temperature detecting transistor, the temperature measurement circuit measures a current flowing through the temperature detecting transistor in each of the two or more temperature detection circuits to obtain the temperature of each of the two or more temperature detection circuits, the external compensation circuit estimates a temperature distribution in the display portion based on the temperature of each of the two or more temperature detection circuits obtained by the temperature measurement circuit, corrects a measurement result of a current in each of the plurality of pixel circuits based on the estimated temperature distribution, and compensates for a variation in a characteristic of each of the plurality of pixel circuits based on the corrected measurement result, the data signal line drive circuit includes a plurality of sub-drive circuits corresponding one-to-one to a plurality of sets of data signal line groups obtained by grouping the plurality of data signal lines as a set of two or more data signal lines adjacent to each other, and each of the sub-drive circuits drives a corresponding one of the plurality of sets of data signal line groups, and a plurality of temperature detection circuits among the two or more temperature detection circuits is connected to at least one data signal line in one of the plurality of sets of data signal line groups corresponding to each of the sub-drive circuits.

14. The display device according to claim 13, wherein the external compensation circuit estimates a temperature distribution in the display portion based on the temperature obtained by the temperature measurement circuit, corrects a measurement result of a current in each of the plurality of pixel circuits based on the estimated temperature distribution, and performs correction for compensating for the variation in a characteristic of each of the plurality of pixel circuits on image data externally received and representing an image to be displayed based on the corrected measurement result.

15. The display device according to claim 13, wherein the plurality of temperature detection circuits is connected to at least one data signal line located at a substantially center in the one of the plurality of sets of data signal line groups corresponding to each of the sub-drive circuits.

16. The display device according to claim 15, wherein in the one of the plurality of sets of data signal line groups corresponding to each of the sub-drive circuits, the plurality of temperature detection circuits is connected to at least one data signal line between a position corresponding to ⅓ of a number of data signal lines in the one of the plurality of sets and a position corresponding to ⅔ of the number of data signal lines in the one of the plurality of sets from a data signal line located at one end.

17. The display device according to claim 13, wherein the variation in the characteristic of each of the pixel circuits compensated by the external compensation circuit includes a variation in a threshold voltage of the drive transistor.

* * * * *